United States Patent [19]

Nakamura et al.

[11] Patent Number: 4,719,168

[45] Date of Patent: Jan. 12, 1988

[54] DYE-FIXING MATERIAL

[75] Inventors: Koichi Nakamura; Toshiaki Aono, both of Kanagawa, Japan

[73] Assignee: Fuji Photo Film Co., Ltd., Kanagawa, Japan

[21] Appl. No.: 858,910

[22] Filed: Apr. 30, 1986

Related U.S. Application Data

[63] Continuation of Ser. No. 596,133, Apr. 2, 1984, abandoned.

[30] Foreign Application Priority Data

Mar. 31, 1983 [JP] Japan ..... 58-56423
Apr. 1, 1983 [JP] Japan ..... 58-55173

[51] Int. Cl.[4] ..... G03C 5/54; G03C 5/24
[52] U.S. Cl. ..... 430/203; 430/219
[58] Field of Search ..... 430/203, 219, 213

[56] References Cited

U.S. PATENT DOCUMENTS

| | | | |
|---|---|---|---|
| 3,265,498 | 8/1966 | Rogers | 430/219 |
| 4,009,029 | 2/1977 | Hammond et al. | 430/219 |
| 4,022,617 | 5/1977 | McGuckin | 430/351 |
| 4,060,420 | 11/1977 | Merkel et al. | 430/955 |
| 4,088,496 | 5/1978 | Merkel | 430/353 |
| 4,430,415 | 2/1984 | Aono et al. | 430/351 |
| 4,473,632 | 9/1984 | Kitaguchi et al. | 430/203 |
| 4,500,626 | 2/1985 | Naito et al. | 430/203 |

FOREIGN PATENT DOCUMENTS

| | | | |
|---|---|---|---|
| 0076492 | 4/1983 | European Pat. Off. | 430/203 |

*Primary Examiner*—Richard L. Schiling
*Attorney, Agent, or Firm*—Sughrue, Mion, Zinn, Macpeak & Seas

[57] ABSTRACT

A dye-fixing material having a dye-fixing layer which functions so as to fix a mobile hydrophilic dye by applying heat thereto, which dye is formed in an imagewise distribution by exposing to an imagewise pattern of light a heat developable light-sensitive material capable of forming the mobile hydrophilic dye by the reaction with a light-sensitive silver halide upon heating under a substantially water-free condition and subsequently or simultaneously, by heating the light-sensitive material; with the dye-fixing material comprising a support having provided thereon a single or a multiple layer which contains at least (a) a dye-fixing agent and (b) such a compound as to react with or adsorb a silver halide and therethrough, as to function as a development stopper and/or an antifoggant.

11 Claims, No Drawings

DYE-FIXING MATERIAL

This is a continuation of application Ser. No. 596,133, filed Apr. 2, 1984, now abandoned.

FIELD OF THE INVENTION

The present invention relates to a dye-fixing material into which dye image formed in a heat-developable light-sensitive material is to be transferred. In particular, the present invention relates to a dye-fixing material having a dye-fixing layer to which dye image formed in a heat-developable light-sensitive material is transferred by heating without any special supply of solvent from the outside, and fixed.

BACKGROUND OF THE INVENTION

The silver halide-using photography is superior in photographic characteristics, e.g., sensitivity, facility of gradient control, etc., to other photographies such as electrophotography, diazo photography and so on. Therefore, it has so far been employed most prevailingly. In recent years, there has been developed a technique which enables simple and rapid formation of image by changing the image-forming processing of the silver halide-using photography from a conventional wet process using a developing solution or the like into a dry-process by heating or like means.

Heat developable light-sensitive materials are well-known in the field of photographic art, and such materials and the processes therefor are described in, e.g., *Shashin Kogaku no Kiso,* pp. 553–555, Corona Company (1979); *Eizō Jōhō,* p. 40 (April 1978); *Nebletts Handbook of photography and Reprography,* 7th Ed., pp. 32–33, Van Nostrand Reinhold Company; U.S. Pat. Nos. 3,152,904; 3,301,678; 3,392,020 and 3,457,075: British Pat. Nos. 1,131,108 and 1,167,777: and *Research Disclosure,* pp. 9–15 (RD-17029) (June 1978).

Many methods for obtaining color images under a dry condition have been proposed. As for the method of forming color images by binding oxidation products of developing agents to couplers, p-phenylenediamine type of reducing agents and phenolic or active methylene-containing couplers are proposed in U.S. Pat. No. 3,531,286; p-aminophenol type of reducing agents in U.S. Pat. No. 3,761,270; sulfonamidophenol type reducing agents in Belgian Pat. No. 802,519 and *Research Disclosure,* pp. 31–32 (September 1975); and combinations of reducing agents of sulfonamidophenyl type with 4-equivalent couplers in U.S. Pat. No. 4,021,240.

However, the above-described method suffers from the defect that it provides turbid color image, because in such a method both reduced silver image and color image are coextensively produced in optically exposed areas after heat development. As the process for obviating this defect, one which involves the removal of silver image by a liquid treatment, and one which involves the transfer of dye along into another layer, e.g., an image-receiving layer, are considered employable. However, the latter technique has the defect that it is not easy to differentiate between dyes and substances which have not yet undergone the reaction, and to transfer only the dyes.

Another method which comprises introducing a nitrogen-containing heterocyclyl group into a dye, forming a silver salt of the dye, and releasing the dye from the silver salt by heat development is described in *Research Disclosure,* pp. 54–58 (RD-16966) (May, 1978).

This method is unsuitable for common use because it is difficult to inhibit the release of the dye in the unexposed part and therefore, clear image can not be obtained.

A further method which comprises the formation of positive color image using the heat-sensitive silver dye bleach process is described with regard to useful dyes and bleach processes in, e.g., *Research Disclosure,* pp. 30–32 (RD-14433) (April 1976); ibid., pp. 14–15 (RD-15227) (December 1976); U.S. Pat. No. 4,235,957; and so on.

However, the above-described method suffers from the disadvantage that it requires extra step and material for accelerating the bleach of dyes, specifically superposition of an activator sheet upon a heat developable light-sensitive material, heating thereof and so on, and has the defect that the color image obtained is gradually recuded and bleached with the liberated silver, which is coextensive therewith, upon long time storage.

A still another method which comprises the formation of color image by taking advantage of leuco dyes is described in, e.g., U.S. Pat. Nos. 3,985,565 and 4,022,617. However, this method has the defect that it is difficult to incorporate stably leuco dyes in photographic materials and consequently, the photographic materials are gradually stained upon storage.

For the purpose of solving the above-described problems inherent in conventional methods, the present applicants have already proposed a novel light-sensitive material and a novel image-forming method for using such a material (in European Patent Application (OPI) No. 76,492). The above-described light-sensitive material has the property that it can release a mobile hydrophilic dye by receiving a simple treatment of being heated in a substantially water-free condition, and the above-described method is characterized by the transfer of the mobile hydrophilic dye released from the above-described material into a dye-fixing layer mainly in the presence of a solvent.

As a result of further researches for the above-described invention, it has been found that a mobile hydrophilic dye formed in an imagewise pattern by heating under a substantially water-free condition can be readily transferred into a dye-fixing layer by heating without supplying any solvents at all from the outside, and that it is important for heightening image density and at the same time, for effecting improvement in image sharpness, to incorporate into a dye-fixing material such a compound as to react with or to adsorb a silver halide, thus achieving the present invention.

Since the present invention involves the transfer of the dye present in a light-sensitive material into a separate dye-fixing material, a special contrivance is required of the present invention in order to give excellent qualities to the final image fixed to the dye-fixing material. That is, it becomes necessary to prevent the increase in fog density due to needless progress of development in the transfer step for the purpose of improving the qualities of dye image transferred into the dye-fixing layer.

SUMMARY OF THE INVENTION

Therefore, a first object of the present invention is to provide a dye-fixing material which is well suited for making it possible to carry out the whole image-forming processings, from the light-exposure to the dye-fixation, under the completely dried condition, especially free of any solvent supply, in the image-forming method which enables the improvement in the quality and the keeping stability of image obtained by using a heat developable silver halide photographic material.

A second object of the present invention is to provide a dye-fixing material for dry image forming process, which is well suited for fixing a dye image to its dye-fixing layer, while retaining its excellent contrast, by heating the dye image (which is produced by heat development carried out after or upon the light-exposure) subsequently to or simultaneously with the heat development, without supplying any solvents from the outside.

A third object of the present invention is to provide a dye-fixing material for dry image forming process, which is well suited for fixing a dye image having a high maximum density and having a low minimum density in respect of the image part to its dye-fixing layer by heating the dye image (which is produced by heat development carried out after or at the same time as the light-exposure) subsequently to or simultaneously with the heat development, without supplying any solvents particularly from the outside.

The above-described objects of the present invention are attained with a dye-fixing material having a dye-fixing layer which has such a function as to fix a mobile hydrophilic dye by application of heat to the dye [which dye is formed in an imagewise distribution by exposing to an imagewise pattern of light a light-sensitive material having on a support at least a light-sensitive silver halide, a binder and "a dye-providing compound" (or "dye releasing redox compound", which can form the mobile hydrophilic dye by having chemical concern in the reaction which takes place upon the reduction of silver halide to silver under a high temperature condition), and subsequently or simultaneously by applying heat to the light-sensitive material] with dye-fixing material comprising a support having provided thereon a single or a multiple layer containing at least (a) a dye-fixing agent and (b) such a compound as to react with or adsorb a silver halide.

DETAILED DESCRIPTION OF THE INVENTION

It is particularly effective in achieving the foregoing objects to incorporate such a compound as to react with or adsorb a silver halide as a development stopper and/or an antifoggant in one of the constituent layers of the dye-fixing material. In particular, it is preferred to incorporate the above-described compound in the dye-fixing layer or a layer provided over the dye-fixing layer, e.g., a protective layer, from the standpoint of depressing rapidly overdevelopment of the light-sensitive layer at the time of transfer of dyes by heating and thereby, providing sharp dye images. As examples of the compounds having the above-described effect, mention may be generally made of nitrogen-containing heterocyclic compounds. Among these compounds, 5- or 6-membered nitrogen-containing heterocyclic compounds are particularly advantageous.

These nitrogen-containing compounds which can be used in the present invention are represented by the following general formulae.

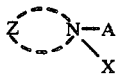

(I)

-continued

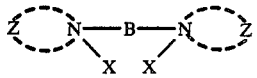

(II)

In the foregoing general formulae (I) and (II), A represents a substituted or unsubstituted alkyl group, an alkenyl group, an alkinyl group, an aralkyl group, an alicyclic hydrocarbon group, or a substituted or unsubstituted aryl group; and B represents a substituted or unsubstituted divalent hydrocarbon group, with preferable examples including $-(CH_2)_n-$, $-CH_2O-(CH_2)_n-O-CH_2-$,

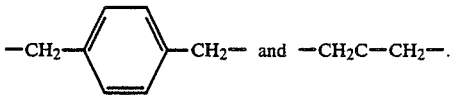

Therein, n represents an integer ranging from 1 to 12, X represents an anion except for iodine, and Z represents non-metal atoms capable of forming a heterocyclic ring together with the nitrogen atom.

More attractive examples of the nitrogen-containing 5- or 6-membered heterocyclic compounds and condensed rings thereof include those having the following general formulae.

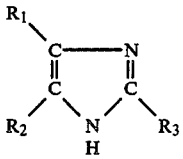

(III)

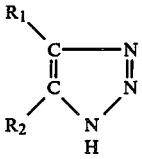

(IV)

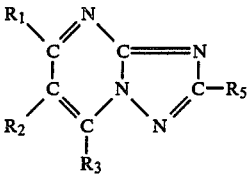

(V)

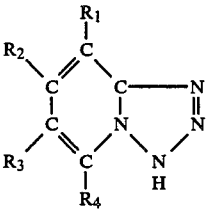

(VI)

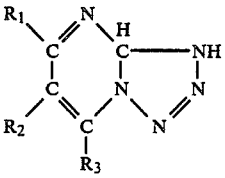

(VII)

-continued (VIII)

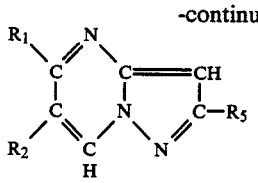

(IX)

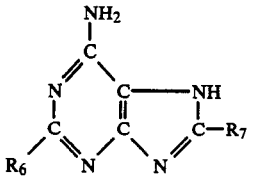

(X)

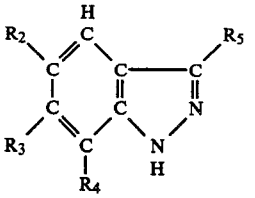

(XI)

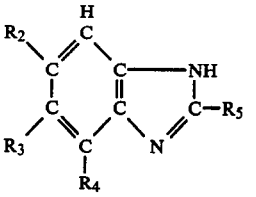

(XII)

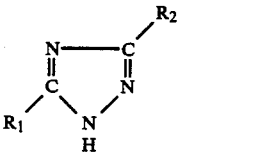

(XIII)

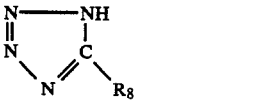

(XIV)

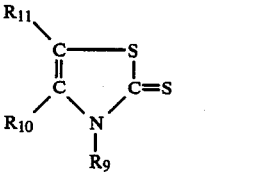

(XV)

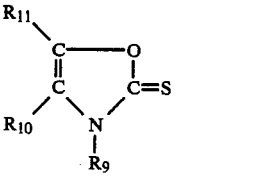

In the foregoing general formulae (III) to (XV), $R_1$, $R_2$, $R_3$ and $R_4$ each represents a hydrogen atom, an alkyl group, an aralkyl group, an alkenyl group, an alkoxy group, an aryl group, —NRR′, —COOR, —$SO_3M$, —CONRR′, —$NHSO_2R$, —$SO_2NRR'$, —$NO_2$, a halogen atom, —CN or a hydroxy group (, wherein R and R′ each represents a hydrogen atom, an alkyl group, an aryl group or an aralkyl group; and M represents a hydrogen atom or an alkali metal atom). In case that both $R_1$ and $R_2$ represents alkyl groups, they may combine with each other and form an aliphatic hydrocarbon ring.

$R_5$ represents a hydrogen atom, an alkyl group containing 1 to 5 carbon atoms, or —S—R″ (, wherein R″ represents a hydrogen atom, an alkyl group, an aryl group or an aralkyl group).

$R_6$ represents a hydrogen atom or an alkyl group, and $R_7$ represents a hydrogen atom, an alkyl group or an aryl group.

$R_8$ represents an alkyl group, an aryl group, a benzyl group, or a pyridyl group; and $R_9$ represents an alkyl group, an alkenyl group, or an aryl group.

$R_{10}$ and $R_{11}$ both represent an alkyl group, an alkenyl group, or an aryl group, and when both $R_{10}$ and $R_{11}$ are alkenyl group, they may combine with each other and form an aromatic ring.

In the present invention, it is particularly desirable to use a nitrogen-containing heterocyclic compound having a mercapto group which is represented by the following general formula (XVI):

(XVI)

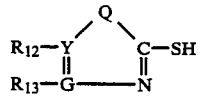

wherein Q represents an oxygen atom, a sulfur atom or —NR‴ (wherein R‴ represents a hydrogen atom, an alkyl group, an unsaturated aliphatic hydrocarbon residue, or a substituted or unsubstituted aryl or aralkyl group); Y and G each represents a carbon atom or a nitrogen atom; and $R_{12}$ and $R_{13}$ each represents a hydrogen atom, an alkyl group, an unsaturated aliphatic hydrocarbon residue, a substituted or unsubstituted aryl group, substituted or unsubstituted aralkyl group, —SR⁗ or —$NH_2$ (wherein R⁗ represents a hydrogen atom, an alkyl group, an aryl group, an aralkyl group, an alkylcarboxylic acid or its alkali metal salt, or an alkylsulfonic acid or its alkali metal salt), and when Y and G both represent carbon atom they may combine with each other and form an aromatic ring.

In addition, thiourea and its derivatives which are represented by the following general formula (XVII) are extremely effective in stopping overdevelopment or in preventing fog-generation through the reaction with silver halides and/or the adsorption of silver halides thereon:

(XVII)

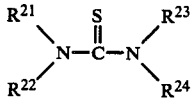

wherein $R^{21}$ to $R^{24}$ may be the same or different, and they each represents a hydrogen atom, a substituted or unsubstituted alkyl group (e.g., methyl, ethyl, cyclohexyl, hydroxyethyl, carboxypentyl, diethylaminopropyl, etc.), a substituted or unsubstituted alkenyl group (e.g., allyl), a substituted or unsubstituted aralkyl group (e.g., benzyl), a substituted or unsubstituted aryl group (e.g., phenyl, p-tolyl, m-methoxyphenyl, etc.), a nitrogen-containing heterocyclyl group (e.g., pyridyl, quinolyl, thiazolyl, thiadiazolyl, oxazolyl, benzothiazolyl, benzoxazolyl, imidazolyl, benzoimidazolyl, triazolyl, morpholinyl, benzotriazolyl, etc.), or an acyl group (e.g., methoxy, ethoxy, benzoyl, etc.).

In the foregoing general formula, $R^{21}$ and $R^{22}$, or $R^{23}$ and $R^{24}$ may also combine with each other and form a 5-, 6- or 7-membered ring containing carbon, nitrogen, oxygen and/or sulfur atoms; or $R^{21}$ and $R^{23}$, or $R^{22}$ and $R^{24}$ may also combine with each other and form a 5-, 6- or 7-membered ring containing carbon, nitrogen, oxygen and/or sulfur atoms.

Among the compounds having the above-described general formulae, typical representative ones which can be used in the present invention are illustrated below.

(1)

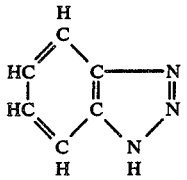

(2)

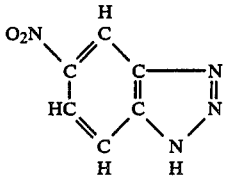

(3)

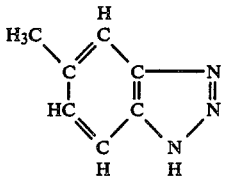

(4)

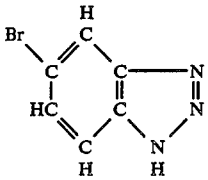

(5)

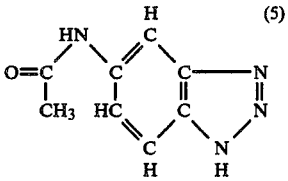

(6)

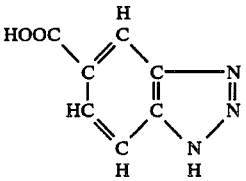

(7)

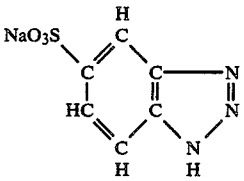

(8)

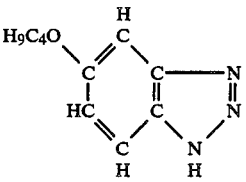

(9)

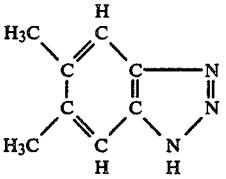

(10)

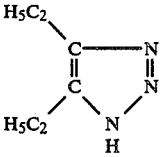

(11)

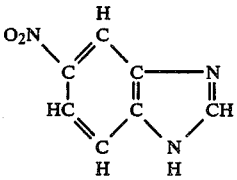

(12)

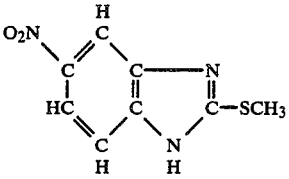

-continued (13)

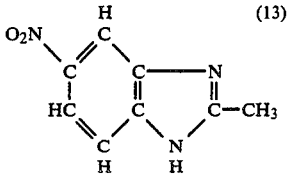

(14)

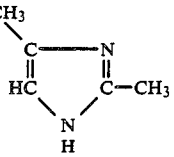

(15)

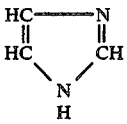

(16)

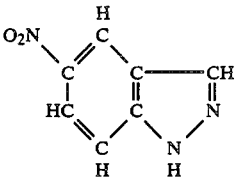

(17)

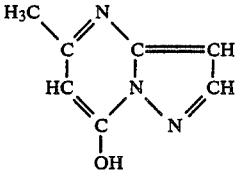

(18)

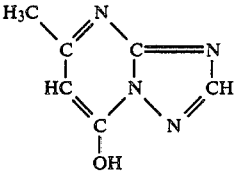

(19)

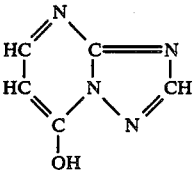

(20)

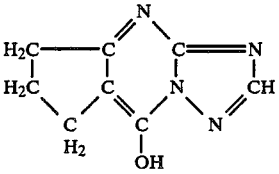

(21)

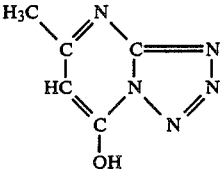

(22)

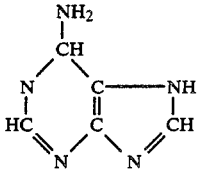

(23)

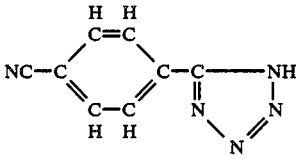

(24)

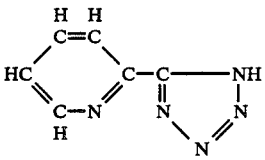

(25)

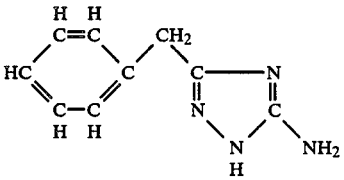

-continued
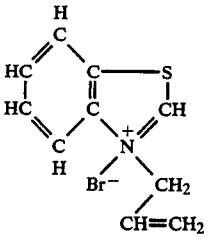
(26)
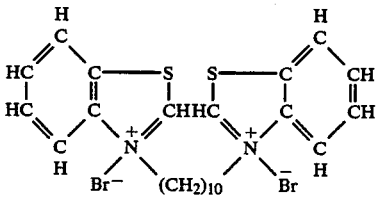
(27)
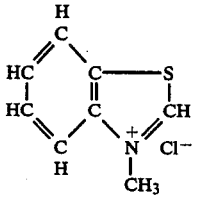
(28)
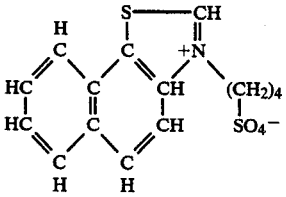
(29)
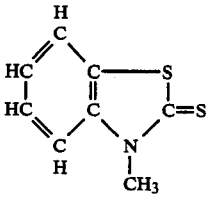
(30)
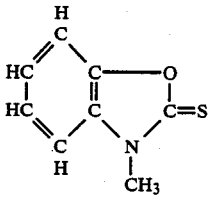
(31)
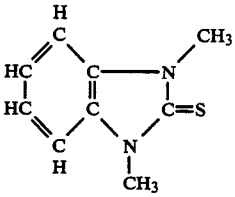
(32)
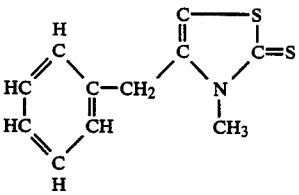
(33)
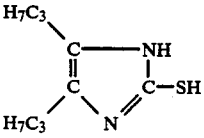
(34)
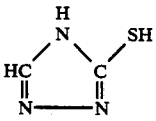
(35)
-continued
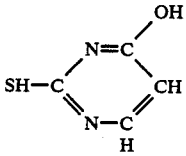
(36)
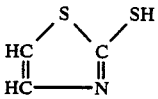
(37)
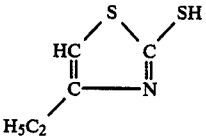
(38)
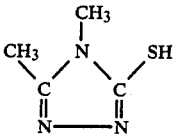
(39)
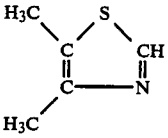
(40)
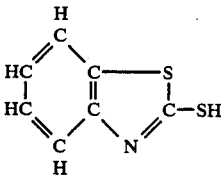
(41)
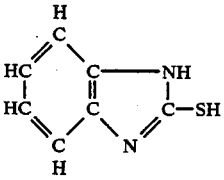
(42)
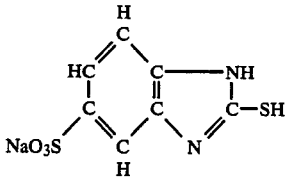
(43)
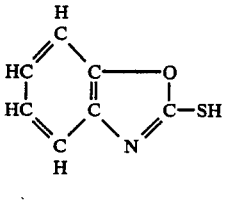
(44)
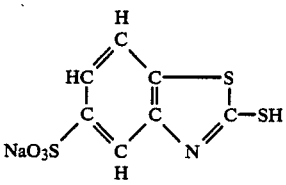
(45)
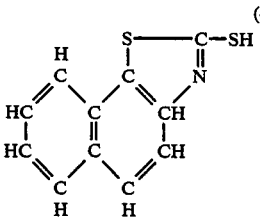
(46)
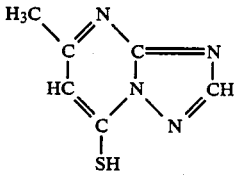
(47)
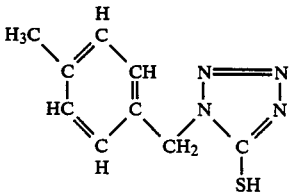
(48)

-continued

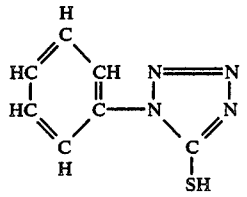

(49)

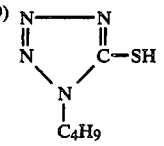

(50)

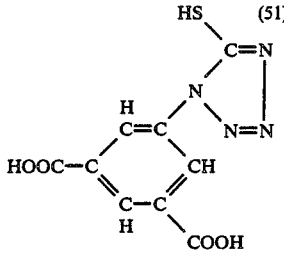

(51)

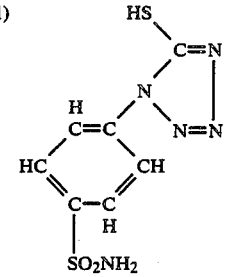

(52)

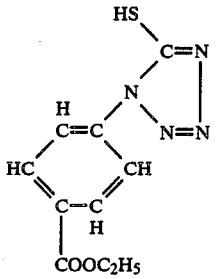

(53)

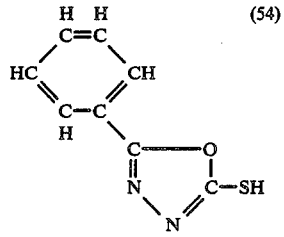

(54)

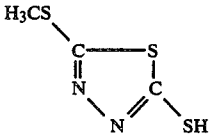

(55)

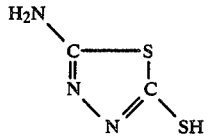

(56)

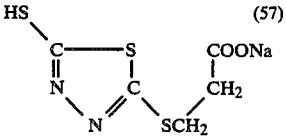

(57)

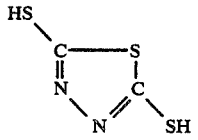

(58)

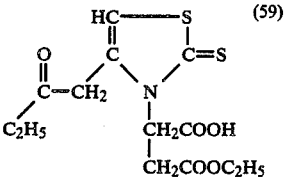

(59)

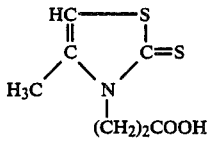

(60)

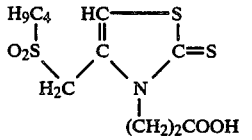

(61)

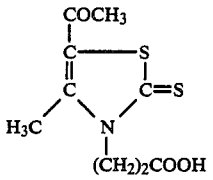

(62)

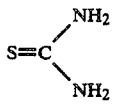

(63)

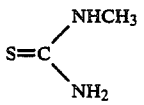

(64)

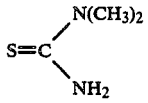

(65)

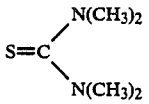

(66)

-continued

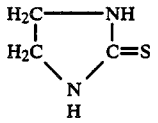

(67)

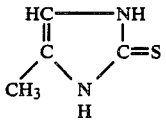

(68)

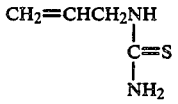

(69)

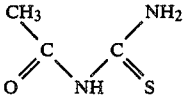

(70)

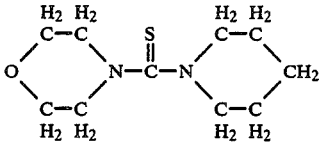

(71)

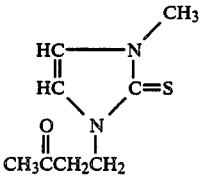

(72)

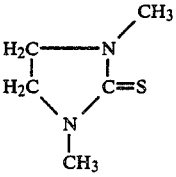

(73)

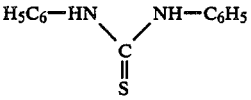

(74)

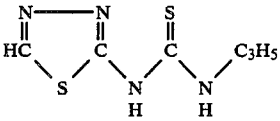

(75)

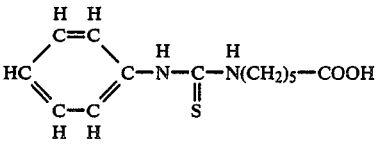

(76)

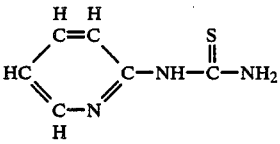

(77)

In addition to the compounds illustrated above, silver halide-complexing agents of substituted heterocyclic ring type, for examples, the thiazolines, the oxazolines, the imidazolines and imidazolidines described in U.S. Pat. No. 4,168,169: and further, silver halide-complexing agents which, though do not come into the categories of the foregoing general formulae, are generally known as fixing agents for silver halide light-sensitive materials, for example, thiosulfates and thiocyanates, can be also employed in the present invention.

Herein, the term complexing agent signifys such a compound as to remove silver ion from a silver ion-containing emulsion by dissolving the silver ion therein, or such a compound as to convert a light-sensitive silver halide to light-insensitive one or to impart development inertness to a light-sensitive silver halide by reacting with or adsorbing silver ion, that is, a so-called stabilizing compound. Such an agent can be used within the range of 1/1000 to 10 moles, preferably 1/1000 to 5 moles, per mole of silver in the light-sensitive material.

In the light-sensitive material employed in the present invention, a mobile hydrophilic dye image can be formed coextensively with silver image in either exposed part or unexposed part by using exposed light-sensitive silver halide as a catalyst, and heating said material under a substantially water-free condition subsequently to or simultaneously with imagewise exposure. Such a developing step as described above is called "heat development" in the present invention. If the sensitive material is left as it received the heat development, it is difficult to mark off the mobile hydrophilic image dye formed and the keeping quality of the image dye formed is greatly deteriorated, because unreacted dye-providing compound, silver halide, developed silver and so on are copresent. However, the present invention enables the transfer of the thus formed image dye into a dye-fixing layer under the atmosphere in which an hydrophilic dye has sufficient affinity, because the image dye formed in the heat development is hydrophilic and that, mobile. Accordingly, the present invention can provide dye image excellent in image quality and keeping quality. This transfer step of image dye means the step of "dye fixation" in the present invention. It was already disclosed in European Patent Applications Nos. (OPI) 76,492 and 79,056 and Japanese Patent Application No. (OPI) 149049/83 that this step can be embodied by supplying mainly a solvent. Moreover, the present invention employs the atmosphere for which hydrophilic dyes have affinity by making a hydrophilic thermal solvent be present inside. Accordingly, any particular solvents need not be supplied from the outside in the dye fixation step. That is, processing in completely dry condition which requires no solvent supply from the outside is carried out in all steps, from the imagewise exposure to the heat development and further, to the dye fixation, in the present invention. In accordance with the embodiment of the present invention, dye image excellent in color reproducibility can be obtained.

In addition, since such a compound as to react with and/or to adsorb silver halides is present in the dye-fixing material of the present invention, the depression of the fog speck growth, the cessation of developing reaction of unexposed silver halide grains, and so on become feasible. Therefore, the minimum density in the unexposed area can be controlled to a low value. Although a clear account cannot be given of the mechanism of the above-described effects, the maximum density in the image part can be heightened and the minimum density in the image part can be lowered by those effects. As the result, dye image of excellent quality can be formed.

The principle of such effects is substantially the same with the case wherein a negative emulsion is used as the emulsion of the sensitive material as with the case wherein an autopositive emulsion is used, except the difference whether the part to be developed is in the exposed area or in the unexposed area. Consequently, in analogy with the case wherein a negative emulsion is used, dye image of excellent color reproducibility can be obtained in the case wherein an auto-positive emulsion is used.

The expression "heating under a substantially water-free condition" in the present invention means that the reaction system is heated at a temperature within the range of 80° C. to 250° C. under such a condition that it is in equilibrium with moisture in the air and that, it does not have any water supply from the outside which has so far been carried out with the intention of bringing out or accelerating the reaction. Details of such a condition as described above is illustrated in *The Theory of the Photographic Process*, 4th Ed. (edited by T. H. James), page 374, Macmillan.

In the present invention, the description "forming a mobile dye by having chemical concern in the reaction which takes place upon the reduction of silver halide to silver under a high temperature condition" means that to take the case of a negative silver halide emulsion as an example, development nuclei are producted in silver halide by light-exposure and the resulting silver halide undergoes the redox reaction with a reducing agent or a reductive dye-providing compound and thereby, (1) the reductive dye-providing compound is oxidized to release a mobile hydrophilic dye; (2) the reducing agent is oxidized to be converted to its oxidant, and said oxidant causes the reaction with a compound capable of forming or releasing a mobile hydrophilic dye to make said compound form or release the mobile hydrophilic dye; (3) a dye-providing compound of the kind which does not have by nature such a property as to release a mobile dye by heating causes the redox reaction with the residual reducing agent to release a mobile dye; or (4) a reductive dye-providing compound which has originally such a property as to release a mobile by heating is oxidized to lose the function of releasing a mobile dye. These four types of reactions take place in the unexposed area in the case where a positive silver halide emulsion is employed instead of a negative silver halide emulsion. In the cases of the reactions (1) and (2), dye image having a positive relationship to silver image is obtained, while in both cases of the reactions (2) and (3) dye image having a negative relationship to silver image is obtained.

As example of such a compound as to form or release a mobile dye which can be employed in the present invention, mention may be made of five kinds of compounds illustrated below.

(i) Dye-Providing compounds which can release mobile dyes be reacting with the oxidants of reducing agents formed by the redox reaction with silver halides caused by heating, (compound in the case of the reaction (2) above)

The compounds described in European Patent Application (OPI) No. 79,056 come under this category. These compounds are represented by the general formula, C-L-D, wherein D represents an image-forming dye moiety illustrated below, L represents a linakge moiety whose C-L bond splits off upon the reaction of the C moiety with the oxidant of a reducing agent, and C represents a substrate which enters into combination with the oxidant of a reducing agent, such as an active methylene residue, an active methine residue, a phenol residue or a naphthol residue, preferably one which has the following general formula (A) to (G):

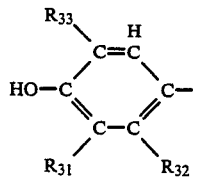

(A)

-continued (B)

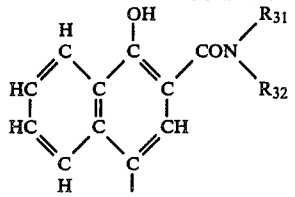

(C)

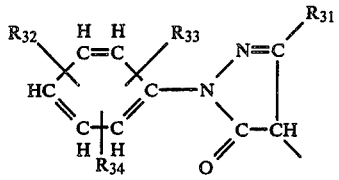

(D)

$R_{31}COCHCOR_{32}$ (E)

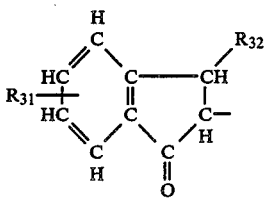

(F)

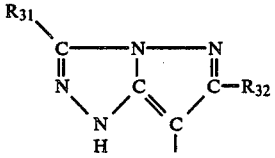

(G)

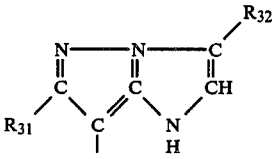

In the foregoing formulae, substituents $R_{31}$, $R_{32}$, $R_{33}$, and $R_{34}$ each represents a hydrogen atom, an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group or a cyano group, and each of these substituent groups may be substituted by a hydroxyl group, a cyano group, a nitro group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

The substrate C must have not only the function of releasing a mobile dye by combining with the oxidant of a reducing agent, but also a ballast group in order to impart to the dye-providing compound such a property that the compound itself may not diffuse into a dye-accepting image-receiving layer. Suitable examples of such a ballast group include hydrophobic groups such as alkyl, alkoxyalkyl and aryloxyalkyl groups, desirably those containing 6 or more carbon atoms in all. In addition, it is desirable for the substrate C to have the total carbon number of 12 or more.

(ii) Couplers which can form mobile dyes by the coupling reaction with the oxidation products of reducing agents which are produced by the redox reaction with silver halides under high temperature conditions (, which correspond to the compounds capable of forming mobile dyes according to the above-described reaction (2))

Examples of such couplers are described above include those described in Japanese Patent Applications Nos. (OPI) 149046/83 and 149047/83 and that, having in their eliminable groups such a moiety as to impart sufficiently high diffusion resistance to the couplers.

The term diffusion resistance in this case signifys such a state that movement of molecules in a hydrophilic binder is inhibited mainly due to size and shape of the molecules. Imparting diffusion resistance to couplers can be effected by introducing a non-diffusible ballast group into the eliminable group of the coupler. On the other hand, dyes produced by the reaction of couplers with the oxidants of reducing agents do not have any ballast groups. Therefore, they are full of mobility.

Non-diffusible couplers as described above are substrates which can form dyes by combining with the oxidants of reducing agents to be produced by the reaction of silver halides with p-aminophenol derivatives or p-phenylenediamine derivatives which are representative of the reducing agents, and can be represented by the following general formula (LI) to (LIX):

(LI)

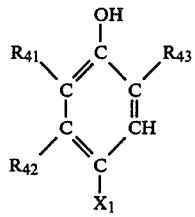

(LII)

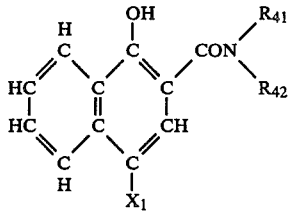

(LIII)

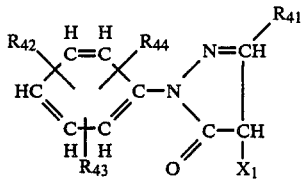

(LIV)

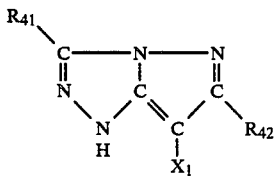

-continued (LV)

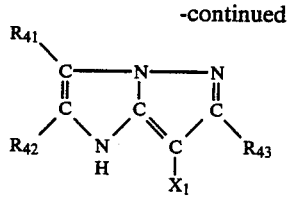

(LVI)

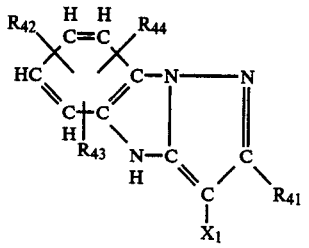

(LVII)

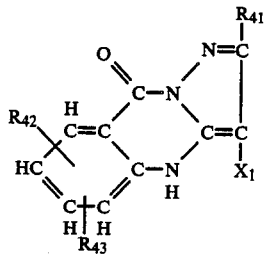

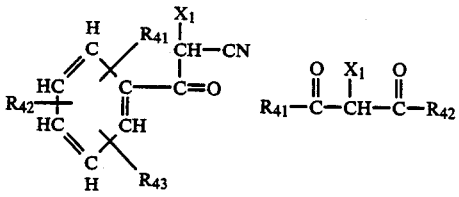

In the foregoing general formula, each of the substituents $R_{41}$ to $R_{44}$ represents a hydrogen atom, an alkyl group, an alkenyl group, a cycloalkyl group, an aryl group, an aralkyl group, an alkoxy group, an aryloxy group, an acyl group, an acyloxy group, an acylamino group, an alkoxyalkyl group, an aryloxyalkyl group, an alkoxycarbonyloxy group, an alkoxycarbonylamino group, an alkoxycarbonyl group, a carbamoyl group, a substituted carbamoyl group, a sulfamoyl group, a substituted sulfamoyl group, an amino group, an alkylamino group, a dialkylamino group, an arylamino group, a cycloalkylamino group, a halogen atom, a cyano group, an acyloxyalkyl group, a nitro group, an alkylsulfonyl group, an arylsulfonyl group, a hydroxyl group, a carboxyl group, a sulfonyl group, an ureido group, a substituted ureido group, a sulfamoylamino group, a substituted sulfamoylamino group, an alkylsulfonyloxy group, an arylsulfonyloxy group, an alkylsulfonylamino group, an arylsulfonylamino group, an alkylthio group, an arylthio group, a heterocyclyl group, an imido group, or a quaternary ammonium group. Each of the above-described substituents may be further substituted by a hydroxyl group, a carboxyl group, a sulfonyl group, an alkoxy group, a cyano group, a nitro group, an alkyl group, an aryl group, an aryloxy group, an acyloxy group, an acyl group, a sulfamoyl group, a substituted sulfamoyl group, a carbamoyl group, a substituted carbamoyl group, an acylamino group, an alkylsulfonylamino group, an arylsulfonylamino group, an sulfamoylamino group, a substituted sulfamoylamino group, an imido group, a halogen atom or a quaternary ammonium group. A total number of carbon atoms contained in each of the substituents $R_{41}$ to $R_{44}$ is 12 or less, and each of these substituents has 8 or less carbon atoms.

X represents a group capable of being eliminated from the coupler upon the reaction with the oxidant of a reducing agent, with specific examples including an alkoxy group, an aryloxy group, an acyloxy group, an alkoxycarbonyloxy group, a carbamoyloxy group, a substituted carbamoyloxy group, an alkylsulfonyloxy group, an arylsulfonyloxy group, an alkylsulfonylamino group, an arylsulfonylamino group, a perfluoroacylamino group, a sulfamoylamino group, a substituted sulfamoylamino group, an alkylsulfonyl group, an arylsulfonyl group, an alkylthio group, an arylthio group, a heterocyclylthio group, an arylazo group, a heterocyclyl group or an imido group. Each of these groups may be further substituted by an alkyl, an alkenyl group, a cycloalkyl group, an aralkyl group, an aryl group, a halogen atom, an alkoxy group, an aryloxy group, an acyl group, an acylamino group, an acyloxy group, an alkylsulfonylamino group, an arylsulfonylamino group, an alkysulfonyloxy group, an arylsulfonyloxy group, an alkoxycarbonyl group, a substituted ureido group, an alkoxycarbonyloxy group or an alkoxycarbonylamino group. In addition, $X_1$ must contain 8 or more carbon atoms in all.

As described hereinbefore, although dyes produced by binding the foregoing couplers to the oxidants of reducing agents are mobile ones, it is to be desired that the couplers themselves should be immobile. From this point of view, the substituents $R_{41}$ to $R_{44}$ in the foregoing general formula (LI) to (LIX) should be those which act so as not to inhibit the diffusion in a hydrophilic binder, more specifically those which are comparatively hydrophilic and have low molecular weights. On the other hand, the substituent $X_1$ in the foregoing general formulae (LI) to (LIX) should be a hydrophobic, high molecular weight of group which acts so as to inhibit diffusion of the coupler itself, that is, acts as a ballast group.

(iii) Non-diffusible compounds which, though do not release mobile dyes by nature, release mobile dyes only when reduced (, which correspond to the case of the foregoing reaction (3))

The compounds described in U.S. Pat. No. 4,139,379 which undergo an intramolecular nucleophilic reaction come under this category.

Non-diffusible dye-providing compounds which cannot inherently release hydrophilic dyes but can release hydrophilic dyes only when reduced (which are called a reducible dye-releasing agent) include, for example, immobile ballasted compounds which can release mobile dyes when receive intramolecular nucleophilic displacement.

The above-described reducible dye-releasing agent can exhibit its usefulness only when used in combination with an electron doner (, that is, a compound which acts as a reducing agent and provides an electron necessary to enable the reducible dye-releasing agent to be reduced in such a form as to receive intramolecular nucleophilic displacement). In the event that an electron doner comes to the condition that it is yielded in an imagewise distribution in a photographic element by light-exposure, electrons are provided from the electron doner molecules to ballasted electron-accepting nucleophilic displacement compound molecules depending on the imagewise pattern and consequently, imagewise pattern of displacement takes place successively to release a dye.

The above-described compounds among the reducible dye-releasing agents which are found to be particularly useful for heat developable color photographic processing methods and photographic elements can be represented in the following schematic formula:

$$\left(\begin{matrix}\text{Ballasted}\\ \text{Carrier}\end{matrix}\right)_x - \left(\begin{matrix}\text{Electrophilic}\\ \text{Eliminable Group}\end{matrix}\right)_y - \left(\begin{matrix}\text{Diffusible}\\ \text{Dye Moiety}\end{matrix}\right)_z$$

wherein x, y and z each is a positive integer, preferably 1 or 2; which includes compounds having more than one diffusible moiety attached to one ballast group or more than one ballast atttached to one diffusible moiety; Ballasted Carrier is a group which renders said compound immobile under a thermal diffusion transfer condition; said Ballasted Carrier contains a group which, upon acceptance of at least one electron, provides a nucleophilic group (a group capable of undergoing intramolecular nucelophilic displacement with an electrophilic cleavage group).

The above-described reducible dye-releasing agents contain an electrophilic eliminable group in their linkage group which connect Ballasted Carrier to their respective diffusible moieties, and upon the reaction of said electrophilic eliminable group with a nucleophilic group produced by reduction, a part of the linkage group will remain with the ballasted carrier and a part of said group will remain with the diffusible moiety.

The reducible dye-releasing agent contains a nucleophilic precursor group and an electrophilic cleavage group which are combined with each other through a bonding group.

Preferred examples of the reducible dye-releasing agent include the compounds containing from 1 to 5 atoms, preferably 3 or 4 atoms, between the atom which forms the reaction center of the nucleophilic reaction and the atom which forms the reaction center of the electrophilic reaction, which can be represented by the following general formula (CI):

(CI)

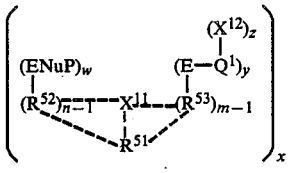

wherein w, x, y, z, n and m each is a positive integer 1 or 2; ENup is a precursor for an electron-accepting nucleophilic group [e.g., a precursor for a hydroxylamino group (such as a nitroso group (NO), a stable nitroxyl free radical (N—O.) or, preferably a nitro group ($NO_2$))] or a precursor for a hydroxy group [, preferably an oxo (=O) group], or it may be an imine group (, which is hydrolyzed to an oxo group in an alkaline environment before accepting an electron): $R^{51}$ is an organic group containing 50 or less atoms, preferably 15 or less atoms; $R^{52}$ and $R^{53}$ can be a divalent organic group containing 1 to 3 atoms in a divalent linkage group, which may be an alkylene group including oxaalkylene, thiaalylene and azaalkylene, or an alkyl- or aryl-substituted nitrogen, and they have large groups in side chains on said linkage group which function as a ballast group, e.g., groups containing at least 8 carbon atoms, which groups will be $X^{11}$ when $X^{11}$ is a ballast group; E and $Q^1$ provide an electrophilic cleavage group, in which E is the center of the electrophilic reaction; Q is a group which can provide a monoatom linkage between E and $X^{12}$ wherein said monoatom involves a non-metal atom of Group Va or Group VIa which is in the divalent or the trivalent state, such as an oxygen atom, a sulfur atom or a selenium atom, and provides two covalent bonds for binding $X^{12}$ to E and as the result, may form a 5- to 7-membered ring together with $X^{12}$ and therein, when said atom is in the trivalent state it may be monosubstituted by a hydrogen atom, an alkyl group containing 1 to 20 carbon atoms, preferably 1 to 10 carbon atoms (including substituted carbon atoms and carbon ring residues) or an aryl group containing 6 to 20 carbon atoms (including substituted aryl groups); $X^{11}$ is a substituent group present on at least one organic group, $R^{51}$, $R^{52}$ or $R^{53}$, and either $X^{11}$ or $Q^1$—$X^{12}$ represents a ballast group which has a large size enough to render the above-described compound immobile in layers of a photographic element, and the remainder represents a photographically useful dye or the precursor thereof and further, $X^{11}$ and $Q^1$—$X^{12}$ contain bonding groups necessary to bind their respective parts to $R^{51}$ and E; and $R^{51}$, $R^{52}$ and $R^{53}$ are selected so as to provide substantial proximity of ENuP to E in order to permit the intramolecular nucleophilic release of $Q^1$ from E and more specifically, selected to provide 1 or 3 to 5 atoms between the atom which is the reaction center of the nucleophilic reaction and the atom which is the reaction center of the electrophilic reaction, whereby said compound is capable of forming a 3- or 5- to 7-membered ring upon intramolecular nucleophilic displacement of the group $Q^1$—$X^{52}$ from said electrophilic group.

(iv) Compounds which, though can inherently release mobile dyes by heating, lose the mobile dye-releasing ability upon the redox reaction with silver halides caused by heating (, which correspond to the case of the foregoing reaction (4))

Such dye-providing compounds as described above include reductants of the nucleophilic groups of the compounds described in U.S. Pat. No. 4,139,379; and they are represented by the general formula (IA) or (IB):

(IA)

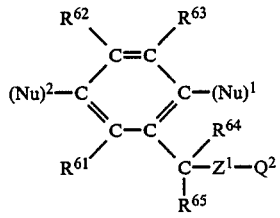

(IB)

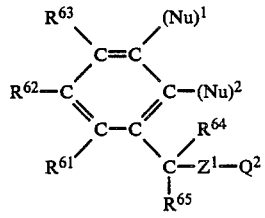

wherein $(Nu)^1$ and $(Nu)^2$ each represents a nucleophilic group (e.g., —OH or —$NH_2$), $Z^1$ represents a divalent atomic group which is electrically negative to the carbon atom to which $R^{64}$ and $R^{65}$ are attached (e.g., sulfonyl group), and $Q^2$ represents a dye moiety. In the foregoing formulae, $R^{61}$, $R^{62}$ and $R^{63}$ each is a hydrogen atom, a halogen atom, an alkyl group, an alkoxy group or an acylamino group, and when $R^{61}$ and $R^{62}$ are on the adjacent positions of the ring, they may be taken together to form a condensed ring with the remainder of the molecule and further, $R^{62}$ and $R^{63}$ also may be taken together to form a condensed ring with the remainder of the ring with the proviso that they are on the adjacent positions of the ring. $R^{64}$ and $R^{65}$ may be the same as or different from each other, and they each represents a hydrogen atom, a hydrocarbon residue or a substituted hydrocarbon residue. At least one substituent among $R^{61}$, $R^{62}$, $R^{63}$, $R^{64}$ and $R^{65}$ contains a large group enough to inhibit the movement of said compound in the layer, that is to say, a non-diffusible group.

A residue having an ability of imparting diffusion resistance is intended to include such residues as to inhibit the compounds having said residues from moving in hydrophilic colloids to be ordinarily used for photographic materials.

Organic residues which can bear a straight or branched chain aliphatic residue, or a carbon, heterocyclic or aromatic ring residue having generally 8 to 20 carbon atoms can be advantageously used for the above-described purpose. These residues each is bound to the remainder of the molecule directly or indirectly through a linkage, such as —NHCO—, —$NHSO_2$—, —NR— (where R represents a hydrogen atom or an alkyl group), —O—, —S— or —$SO_2$—. The non-diffusible residue may further bear such a group as to impart a solubility in water, e.g., a sulfonyl group or a carboxyl group (which may be present in an anionic form). Since the mobility depends on the molecular size of the compound as a whole, in some cases, e.g., in the case that a size of the molecule as a whole is sufficiently large, it is highly possible for the compound to contain a group having a shorter chain length as "non-diffusible residue".

As another example of the dye-providing compound, mention may be made of one which has the following general formula (IIA):

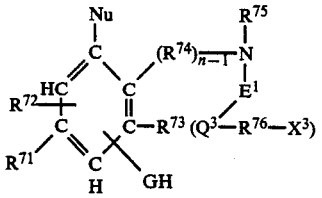

(IIA)

wherein Nu is a nucleophilic group (e.g., —$NH_2$ or —OH); OH is an oxidizable group (e.g., an amino group (including alkylamino groups) or a sumfonamido group), a cyclic group formed with $R^{71}$ or $R^{73}$, or any of the groups specified for Nu.

$E^1$ is an electrophilic group which is carbonyl —CO— or thiocarbonyl —CS—; $Q^3$ is a group providing a monoatom linkage between $E^1$ and $R^{76}$, wherein said monoatom is a non-metal atom of Group Va or Group VIa which is in the divalent or trivalent state, e.g., an nitrogen atom, an oxygen atom, a sulfur atom or a selenium atom, and wherein said monoatom provides two covalent bonds for binding $E^1$ to $R^{76}$, and when it is in the trivalent state said atom is substituted by a hydrogen atom, an alkyl group containing up to 10 carbon atoms (including substituted alkyl groups), an aromatic group containing 5 to 20 carbon atoms (including aryl groups and substituted aryl groups) or atoms necessary to form a 5 to 7-membered ring with $R^{76}$ (such as pyridine or piperidine); $R^{74}$ is an alkylene group containing 1 to 3 carbon atoms in the linkage (including substituted alkylene groups), or one which contains a dialkyl- or di-arylmethylene linkage as at least one methylene constituting said linkage; n is an integer of 1 or 2; $R^{76}$ can be aromatic group containing at least 5 atoms, preferably from 5 to 20 atoms, which includes heterocyclyl groups containing a nucleus such as pyridine, tetrazole, benzimidazole, benzotriazole or isoquinoline, or carbon ring type arylene groups containing 6 to 20 carbon atoms (including preferably phenylene and naphthylene groups substituted by a phenylene or naphthylene group), or $R^{76}$ can also be an aliphatic hydrocarbon residue such as an alkylene group containing 1 to 12 carbon atoms (including substituted alkylene groups); $R^{75}$ can be an alkyl group containing 1 to 40 carbon atoms (including substituted alkyl groups and cycloalkyl groups) or an aryl group containing 6 to 40 carbon atoms (including substituted aryl groups), and it can possess the function as a ballast group.

Each of $R^{73}$, $R^{71}$ and $R^{72}$ may be a monoatomic substituent such as hydrogen or halogen, or preferably a polyatomic substituent such as an alkyl group containing 1 to 40 carbon atoms (including substituted alkyl groups and cycloalkyl groups), an alkoxy group, an aryl group containing 6 to 40 carbon atoms (including substituted aryl groups), a carbonyl group, a sulfamyl group or a sulfonamido group, wherein $R^{72}$ and $R^{71}$ must be polyatomic substituents with the proviso that $R^{76}$ is an aliphatic hydrocarbon residue such as an alkylene group; and $R^{74}$ is selected so as to provide substantial proximity of the nucleophilic group to $E^1$ to permit the intramolecular nucleophilic reaction attended by the release of $Q^3$ from $E^1$, whereby said compound is capable of forming a 5- to 8-membered ring, preferably a 5- or 6-membered ring, upon intramolecular nucleophilic displacement of the group —($Q^3$—$R^{76}$—$X^3$) from said electrophilic group.

(v) Dye releasing redox compound capable of releasing hydrophilic diffusible dyes which can be employed in the present invention (which correspond to the case of the foregoing reaction (1))

Such compounds are represented by the following general formula (CCI):

$$Ra—SO_2—D \qquad (CCI)$$

wherein Ra represents a reducing group capable of being oxidized by the silver halide; and D represents an image forming dye portion containing a hydrophilic group.

Preferably the reducing group Ra in the dye releasing redox compound Ra—$SO_2$'D has an oxidation-reduction potential to a saturated calomel electrode of 1.2 V or less measuring the polarographic half wave potential using acetonitrile as a solvent and sodium perchlorate as a base electrolyte. Preferred examples of the reducing group Ra include those represented by the following general formulae (CCII) to (CCIX).

(CCII)

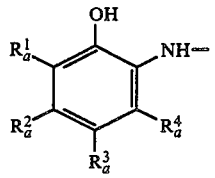

(CCIII)

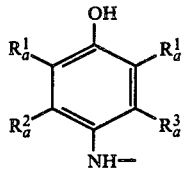

(CCIV)

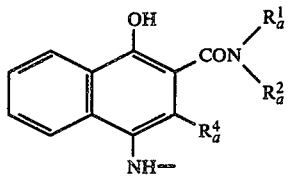

(CCV)

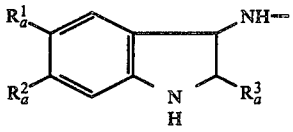

(CCVI)

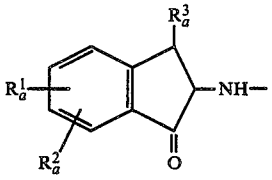

(CCVII)

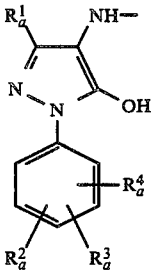

(CCVIII)

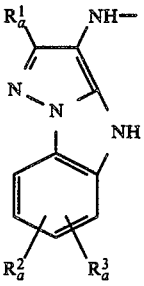

-continued (CCIX)

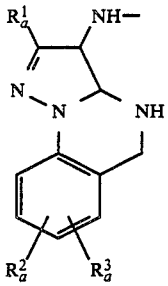

wherein $R_a^1$, $R_a^2$, $R_a^3$ and $R_a^4$ each represents a hydrogen atom or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group. The alkyl moiety and the aryl moiety in the above described substituents may be further substituted with an alkoxy group, a halogen atom, a hydroxy group, a cyano group, an acyl group, an acylamino group, a substituted carbamoyl group, a substituted sulfamoyl group, an alkylsulfonylamino group, an arylsulfonylamino group, a substituted ureido group or a carboalkoxy group. Furthermore, the hydroxy group and the amino group included in the reducing group represented by Ra may be protected by a protective group capable of reproducing the hydroxy group and the amino group by the action of a nucleophilic agent.

In more preferred embodiments of the present invention, the reducing group Ra is represented by the following general formula (CCX).

(CCX)

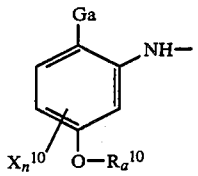

wherein Ga represents a hydroxy group or a group giving a hydroxy group upon hydrolysis; $R_a^{10}$ represents an alkyl group or an aromatic group; n represents an integer of 1 to 3; $X^{10}$ represents an electron donating substituent when n is 1 or substituents, which may be the same or different, one of the substituents being an electron donating group and the second or second and third substituents being selected from an electron donating group or a halogen atom when n is 2 or 3, respectively; wherein $X^{10}$ groups may form a condensed ring with each other or with $OR_a^{10}$; and the total number of the carbon atoms included in $R_a^{10}$ and $X^{10}$ is not less than 8.

Of the reducing groups represented by the general formula (CCX), more preferred reducing groups Ra are represented by the following general formulae (CCXa) and (CCXb):

(CCXa)

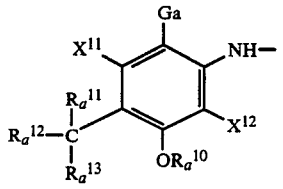

wherein Ga represents a hydroxy group or a group giving a hydroxy group upon hydrolysis; $R_a^{11}$ and $R_a^{12}$, which may be the same or different, each represents an alkyl group or $R_a^{11}$ and $R_a^{12}$ may be bonded to each other to form a ring; $R_a^{13}$ represents a hydrogen atom or an alkyl group; $R_a^{10}$ represents an alkyl group or an aromatic group; $X^{11}$ and $X^{12}$, which may be the same or different, each represents a hydrogen atom, an alkyl group, an alkoxy group, a halogen atom, an acylamino group or an alkylthio group; and $R_a^{10}$ and $X^{12}$ or $R_a^{10}$ and $R_a^{13}$ may be bonded to each other to form a ring, (CCXb)

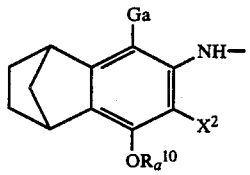

wherein Ga represents a hydroxy group or a group giving a hydroxy group upon hydrolysis; $R_a^{10}$ represents an alkyl group or an aromatic group; $X^2$ represents a hydrogen atom, an alkyl group, an alkoxy group, a halogen atom, an acylamino group or an alkylthio group; and $X^2$ and $R_a^{10}$ may be bonded to each other to form a ring.

Specific examples of the reducing groups represented by the above described general formulae (CCX), (CCXa) and (CCXb) are described in U.S. Pat. No. 4,055,428, Japanese Patent Application (OPI) Nos. 12642/81 and 16130/81, respectively.

In other more preferred embodiments of the present invention, the reducing group Ra is represented by the following general formula (CCXI)

(CCXI)

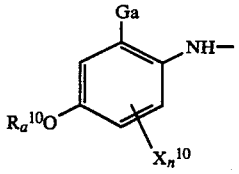

wherein Ga, $X^{10}$, $R_a^{10}$ and n each has the same meaning as Ga, $X^{10}$, $R_a^{10}$ and n defined in the general formula (CCX).

Of the reducing groups represented by the general formula (CCXI), more preferred reducing groups Ra are represented by the following general formulae (CCXIa), (CCXIb) and (CCXIc).

(CCXIa)

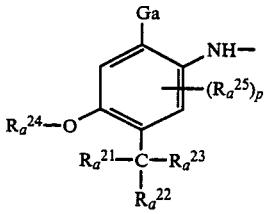

wherein Ga represents a hydroxy group or a group giving a hydroxy group upon hydrolysis; $R_a^{21}$ and $R_a^{22}$, which may be the same or different, each represents an alkyl group or an aromatic group, and $R_a^{21}$ and $R_a^{22}$ may be bonded to each other to form a ring; $R_a^{23}$ represents a hydrogen atom, an alkyl group or an aromatic group; $R_a^{24}$ represents an alkyl group or an aromatic group; $R_a^{25}$ represents an alkyl group, an alkoxy group, an alkylthio group, an arylthio group, a halogen atom or an acylamino group; p is 0, 1 or 2; $R_a^{24}$ and $R_a^{25}$ may be bonded to each other to form a condensed ring; $R_a^{21}$ and $R_a^{24}$ may be bonded to each other to form a condensed ring; $R_a^{21}$ and $R_a^{25}$ may be bonded to each other to form a condensed ring; and the total number of the carbon atoms included in $R_a^{21}$, $R_a^{22}$, $R_a^{23}$, $R_a^{24}$ and $(R_a^{25})_p$ is more than 7.

(CCXIb)

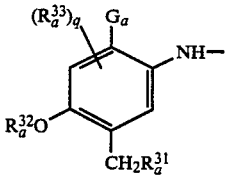

wherein Ga represents a hydroxy group or a group giving a hydroxy group upon hydrolysis; $R_a^{31}$ represents an alkyl group or an aromatic group; $R_a^{32}$ represents an alkyl group or an aromatic group; $R_a^{33}$ represents an alkyl group, an alkoxy group, an alkylthio group, an arylthio group, a halogen atom or an acylamino group; q is 0, 1 or 2; $R_a^{32}$ and $R_a^{33}$ may be bonded to each other to form a condensed ring; $R_a^{31}$ and $R_a^{32}$ may be bonded to each other to form a condensed ring; $R_a^{31}$ and $R_a^{33}$ may be bonded to each other to form a condensed ring; and the total number of the carbon atoms included in $R_a^{31}$, $R_a^{32}$ and $(R_a^{33})_q$ is more than 7.

(CCXIc)

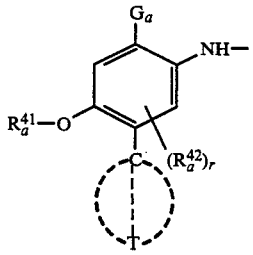

wherein Ga represents a hydroxy group or a group giving a hydroxy group upon hydrolysis; $R_a^{41}$ represents an alkyl group or an aromatic group; $R_a^{42}$ represents an alkyl group, an alkoxy group, an alkylthio group, an arylthio group, a halogen atom or an acylamino group; r is 0, 1 or 2; the group of

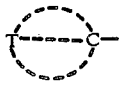

represents a group in which 2 to 4 saturated hydrocarbon rings are condensed, the carbon atom

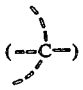

in the condensed ring which is connected to the phenol nucleus (or a precursor thereof), represents a tertiary carbon atom which composes one of the pivot of the condensed ring, a part of the carbon atoms (excluding the above described tertiary carbon atom) in the hydrocarbon ring may be substituted for oxygen atom(s), the hydrocarbon ring may have a substituent, and an aromatic ring may be further condensed to the hydrocarbon ring; $R_a^{41}$ or $R_a^{42}$ and the group of

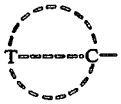

may be bonded to each other to form a condensed ring; and the total number of the carbon atoms included in $R_a^{41}$, $(R_a^{42})_r$ and the group of

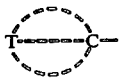

is not less than 7.

Specific examples of the reducing groups represented by the above described general formulae (CCXI), (CCXIa), (CCXIb) and (CCXIc) are described in Japanese Patent Application (OPI) Nos. 16131/81, 650/82 and 4043/82.

The essential part in the groups represented by the general formulae (CCIII) and (CCIV) is a para(sulfonyl)aminophenol part.

In the case that the compounds classified into the foregoing categories (i) to (v) are described in a lump in the present specification, they are described using the term "the dye-providing compounds and the like".

If oxidizing agents of organic silver salt type are copresent, the above-described reaction of forming an imagewise pattern of dye image can proceed with particularly high efficiency and provide image of high density. Accordingly, a particularly preferable embodiment comprises allowing the organic silver salt type oxidizing agents to be copresent in the image-forming reaction system.

Characteristics required of non-diffusible "dye-providing compounds and the like" which are to be employed in the present invention are as follows:

(1) A rate of the reaction in which "the dye-providing compounds and the like" take part is fast and therethrough, mobile dyes for forming image are produced with high efficiency, (2) It is necessary for the non-diffusible "dye-providing compounds and the like" to be rendered immobile in a hydrophilic or hydrophobic bindr, while for only dyes formed in an imagewise pattern to have mobility, (3) "The dye-providing compounds and the like" are synthesized with ease, and so on.

Since dyes for forming image can be selected from a wide variety of combinations composed of various kinds of compounds in the present invention, various colors can be reproduced. Therefore, image can be rendered multicolored by selecting proper combinations. Under these circumstances, dye image of the present invention includes not only monochromatic image but also multicolored image, and the monochromatic image includes those formed by mixing two or more colors.

Suitable examples of the dye moieties contained in "the dye-providing compounds and the like" to be employed in the present invention include azo dyes, azomethine dyes, anthraquinone dyes, naphthoquinone dyes, styryl dyes, nitro dyes, quinoline dyes, carbonyl dyes, phthalocyanine dyes and metal complex salts thereof.

One of the representatives of the dye precursors contained in "the dye-providing compounds and the like" to be employed in the present invention are those capable of providing dyes by hydrolysis, e.g., dyes whose auxochromes are acylated (dyes of the kind which have absorption bands shifted temporarily to shorter wavelengths), as described in, e.g. published unexamined Japanese Patent Application No. 125818/73, and U.S. Pat. Nos. 3,222,196 and 3,307,947. By previously shifting absorption bands of dyes to a shorter wavelength region by acylation and keeping said condition for a while until light-exposure is completed, desensitization due to the absorption of light by the above-described color image-forming agents in the case that said agents are coated in a form of mixture with light-sensitive emulsions can be prevented. In addition, prevention of the desensitization can be effected by utilizing a dye whose hue in an emulsion layer is different from that which said dye shows when transferred onto a mordant. Moreover, the dye moiety can have such a group as to impart good solubility in water, e.g., carboxyl group, sulfonamido group or the like.

In view of the fact that the dye-releasing reaction has so far been considered to be caused by the attack of a so-called nucleophilic agent, and it has been usually conducted in a water solution under high pH conditions, e.g., under pH of 10 or above, it is very exceptional that the dye-releasing reaction manifests a high reaction rate only by applying heat to the reaction system under a substantially water-free condition, as realized by the light-sensitive material used in the present invention. Further, in consideration of the knowledge obtained from wet development carried out at ordinary temperatures, it is also very exceptional that the dye-providing compounds to be employed in the present invention can undergo the redox reaction with silver halides or organic silver salt type oxidizing agents without the help of so-called assistant developers.

Typical representative dyes which are utilizable in the present invention are illustrated below classifying them by hue.

Yellow

-continued
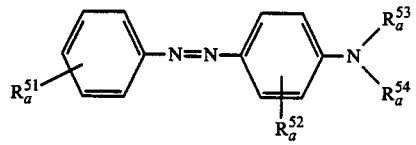
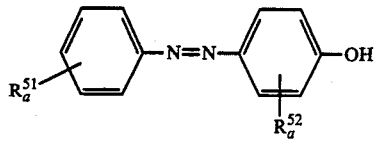
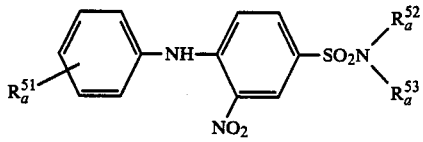
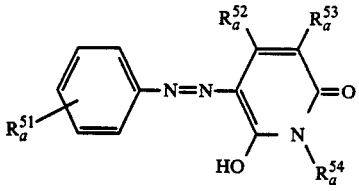
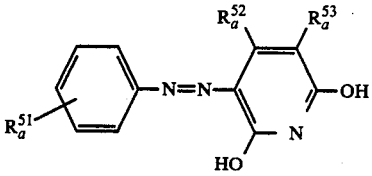
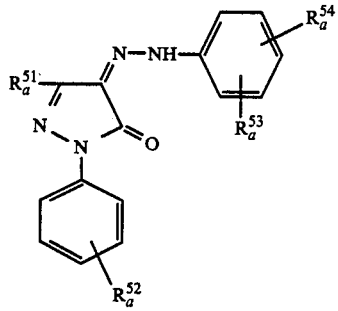
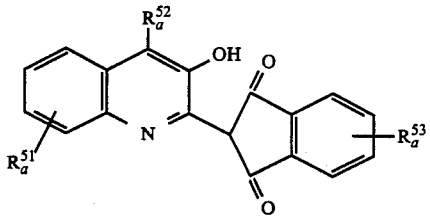
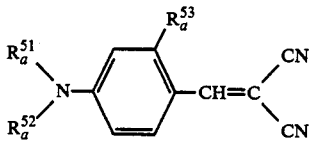
-continued
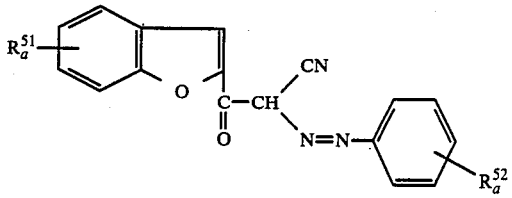
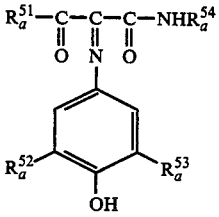
Magenta
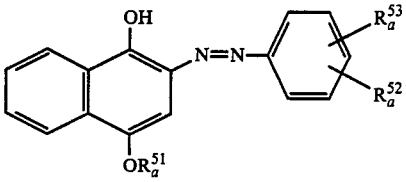
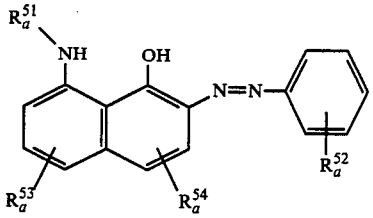
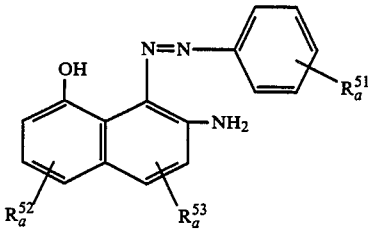
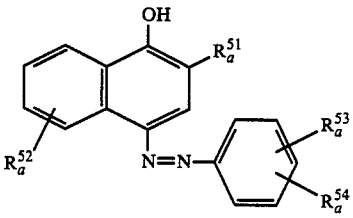

-continued
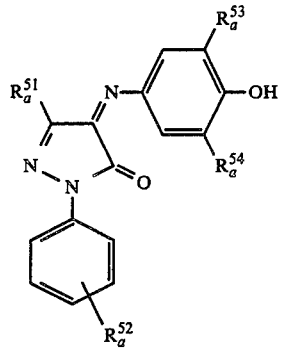
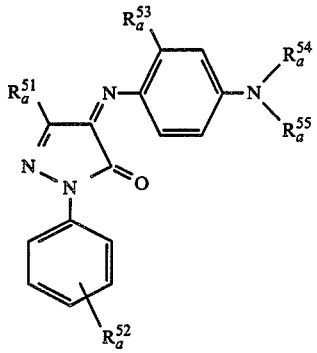
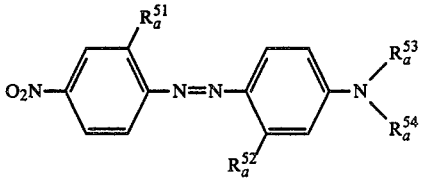
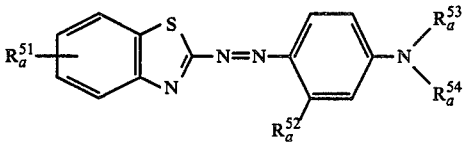
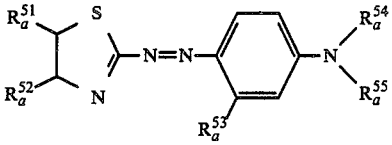
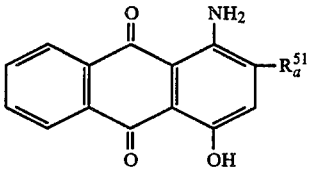
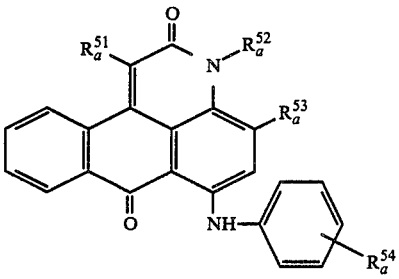
-continued
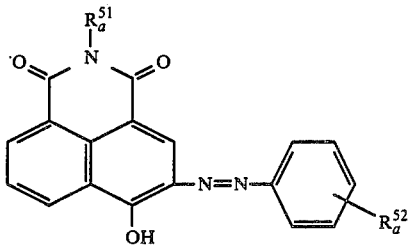
Cyan
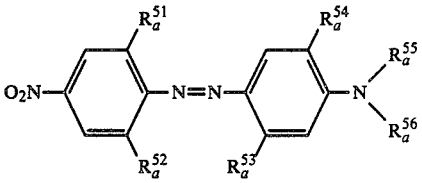
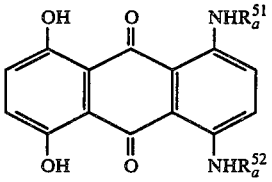
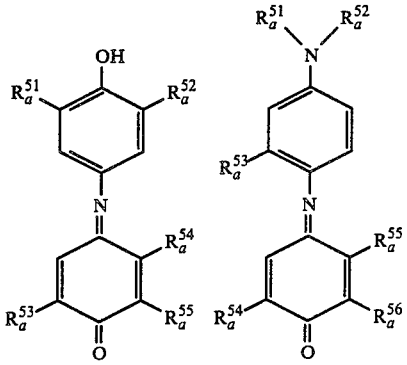
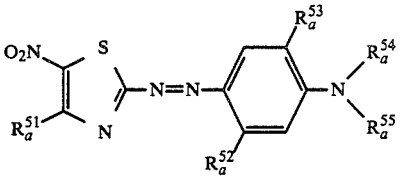
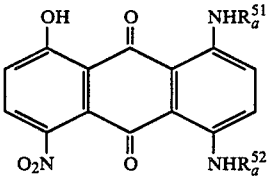
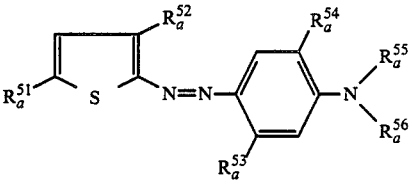

-continued

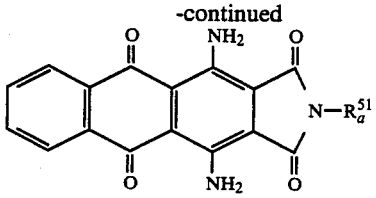

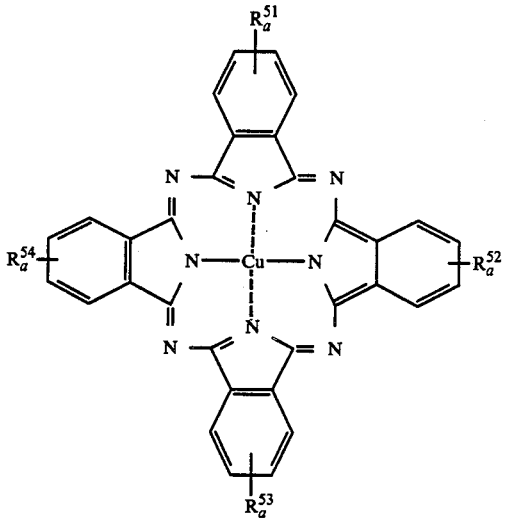

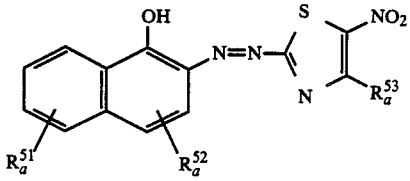

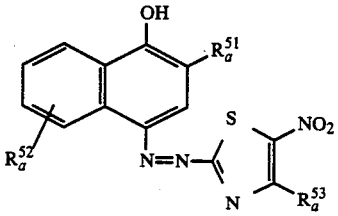

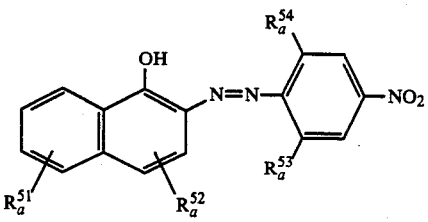

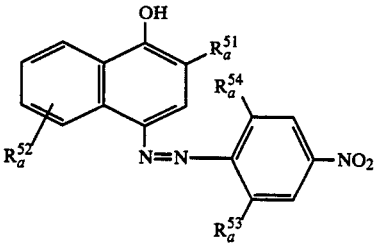

In the above described formulae, $R_a^{51}$ to $R_a^{56}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group or an arylthio group. The alkyl moiety and the aryl moiety in the above described substituents may be further substituted with a halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, an alkylsulfonylamino group, an arylsulfonylamino group or a ureido group.

Examples of the hydrophilic groups include a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group, an alkoxyalkoxy group, etc.

In the present invention, those in which the hydrophilic property thereof is increased by dissociation of a proton under a basic condition are particularly preferred. Examples of these groups include a phenolic hydroxy group, a carboxy group, a sulfo group, a phosphoric acid group, an imido group, a hydroxamic acid group, a (substituted) sulfamoyl group, a (substituted) sulfamoylamino group, etc.

Characteristics required for the image forming dye are as follows.

1. It has a hue suitable for color reproduction.
2. It has a large molecular extinction coefficient.
3. It is fast to light and heat and stable for the dye releasing activator and other additives included in the system; and
4. It is easily synthesized.

Practical examples of the dye-providing compounds are those described in European Patent Application No. (OPI) 76,492. Typical examples of the dye-providing compouns are illustrated below.

EXAMPLES OF THE DYE-PROVIDING COMPOUND CLASSIFIED TO THE FOREGOING KIND (i)

Dye-providing Compound (1):

-continued
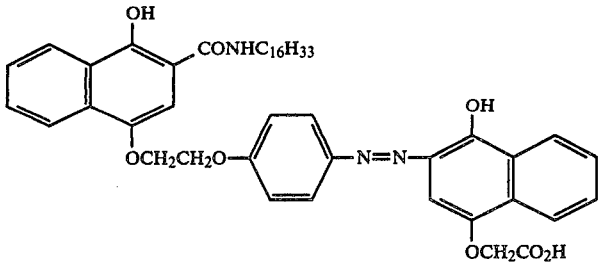
Dye-providing Compound (2):
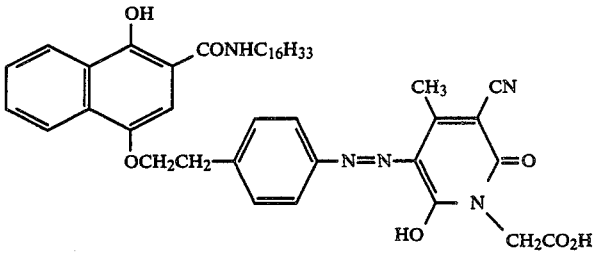
Dye-providing Compound (3):
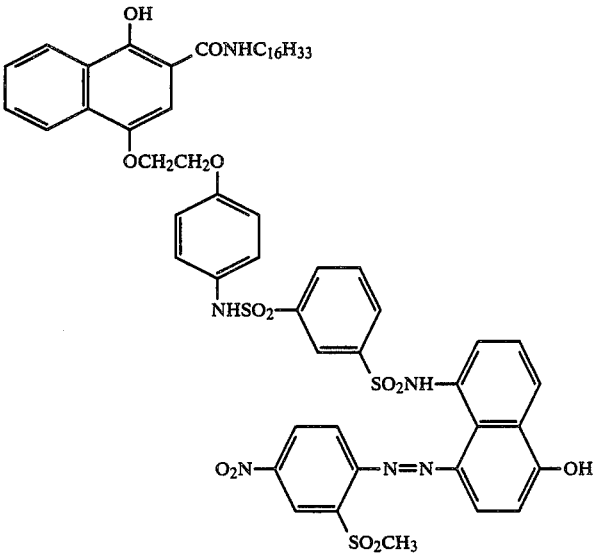
-continued
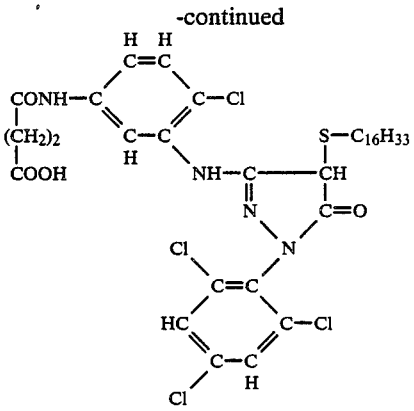
EXAMPLE OF THE COUPLER CLASSIFIED TO THE FOREGOING KIND (ii)
Coupler (M-1):

EXAMPLE OF THE NON-DIFFUSIBLE COMPOUND CLASSIFIED TO THE FOREGOING KIND (iii)
-continued
Non-diffusible Compound (1):
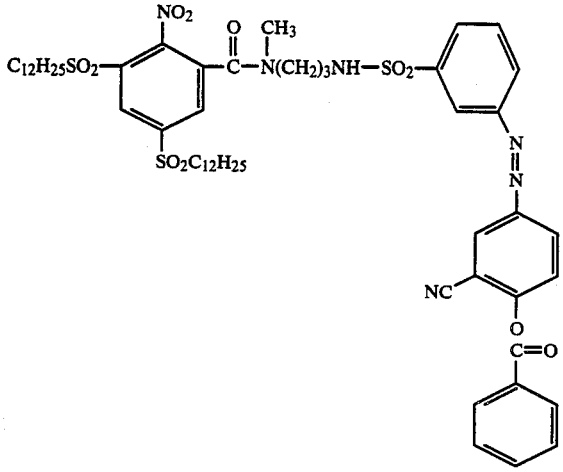
Non-diffusible Compound (2):
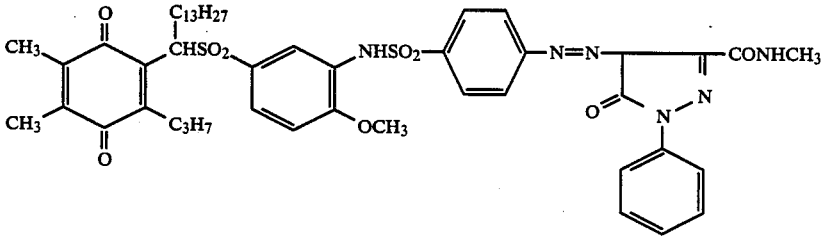
EXAMPLE OF THE COMPOUND CLASSIFIED TO THE FOREGOING KIND (iv)
Compound (1):
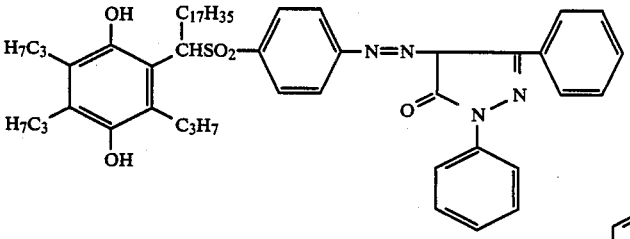
EXAMPLES OF DYE RELEASING REDOX COMPOUND CLASSIFIED TO THE FOREGOING KIND (v)
Dye Releasing Redox Compound (1)
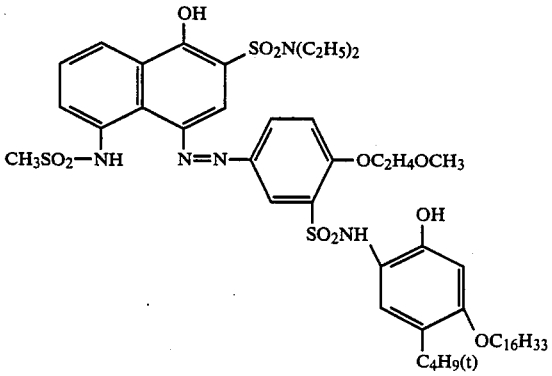
Dye Releasing Redox Compound (2)

-continued

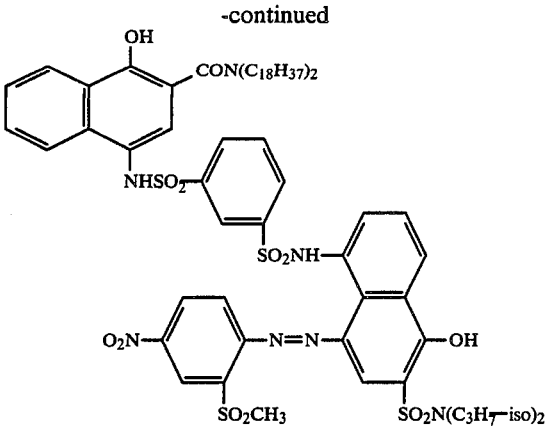

Dye Releasing Redox Compound (3)

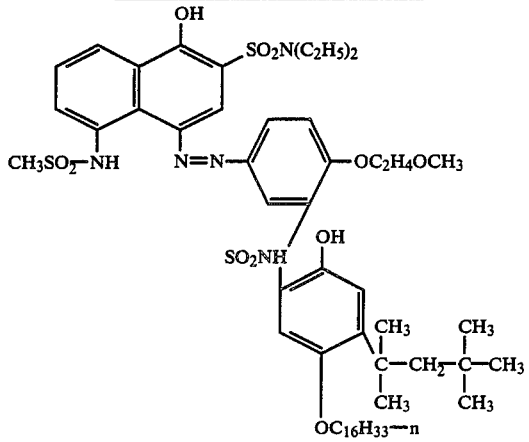

Dye Releasing Redox Compound (4)

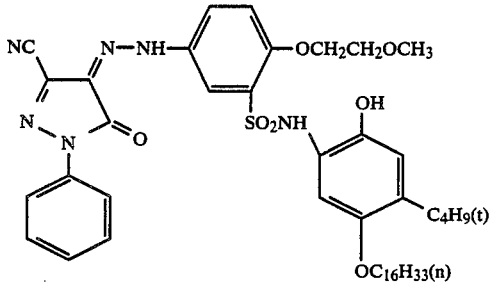

The dye releasing redox compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above-described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

In the present invention, if necessary, a reducing agent may be used. The reducing agent in this case is the so-called auxiliary developing agent, which is oxidized by the silver halide and/or the organic silver salt oxidizing agent to form its oxidized product having an ability to oxidize the reducing group $R_a$ in the dye releasing redox compound.

Examples of useful auxiliary developing agents include the compounds specifically described in European Patent Application (OPI) No. 76,492.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its grain. That is, the silver halide which shows the X-ray diffraction pattern of pure silver iodide is particularly preferred.

In photographic materials a silver halide containing two or more kinds of halogen atoms can be used. Such a silver halide is present in the form of a completely mixed crystal in a conventional silver halide emulsion. For example, the grain of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its grain and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds or sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the above-described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

The silver halide used in this case is not always necessarily to have the characteristic in that the silver halide contains pure silver iodide crystal in the case of using the silver halide alone. Any silver halide which is known in the art can be used.

Examples of such organic silver salt oxidizing agents include those described in European Patent Application (OPI) No. 76,492.

A silver salt of an organic compound having a carboxy group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in Research Disclosure, Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,453, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, etc., a cellulose derivative, a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, can be contained in these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a napthothiazole nucleus, a benzoselenazole nucleus, a benzimidazole nucleus, a quinoline nucleus, etc., are appropriate. The carbon atoms of these nuclei may also be substituted.

As nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be used in merocyanine dyes and complex merocyanine dyes.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japenese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a super-sensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material or used as the dye fixing material, if desired, according to the present invention is that which can endure at the processing temperature. As an ordinary support, not only glass, paper, metal or analogues thereto may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the present invention, various kinds of dye releasing activators can be used. The dye releasing activator means a substance which accelerates the oxidation-reduction reaction between the light-sensitive silver halide and/or the organic silver salt oxidizing agent and dye releasing redox compound, or accelerates release of a dye by means of its nucleophilic action to the oxidized dye releasing redox compound in the dye releasing reaction subsequently occurred, and a base and a base precursor can be used. It is particularly advantageous to use these dye releasing activators in order to accelerate the reactions in the present invention.

Examples of preferred bases are amines which include trialkylamines, hydroxylamines, aliphatic polyamines, N-alkyl substituted aromatic amines, N-hydroxyalkyl substituted aromatic amines and bis[p-(dialkylamino)phenyl]methanes. Further, betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444 are useful. The base precursor is a substance which releases a basic component by heating. Examples of typical base precursors are described in British Pat. No. 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used because they decompose at a high temperature to form bases.

These dye releasing activators can be used in an amount of a broad range. A useful range is up to 50% by weight based on the amount of a dry layer coated of the light-sensitive material. A range of 0.01% by weight to 40% by weight is more preferred.

It is advantageous to use a compound represented by the general formula described below in the heat-developable color photographic material in order to accelerate development and accelerate release of a dye.

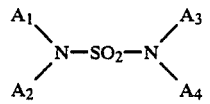

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

The above-described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

Further, in the present invention, it is possible to use a compound which activates development and stabilizes the image at the same time. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)-methylene-bis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, it is possible to use a thermal solvent. The term "thermal solvent" means a non-hydrolyzable organic material which melts at a temperature of heat treatment and melts at a lower temperature of heat treatment when it is present together with other components. Preferred examples of thermal solvents include compounds which can act as a solvent for the developing agent and compounds having a high dielectric constant which accelerate physical development of silver salts. Examples of preferred thermal solvents include those described in European Patent Application (OPI) No. 76,492.

In the present invention, though it is not always necessary to further incorporate substances or dyes for preventing irradiation or halation in the light-sensitive material, because the light-sensitive material is colored by the dye releasing redox compound, it is possible to add filter dyes or light absorbing materials, etc., into the light-sensitive material, as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an antihalation layer, a strippable layer, etc.

The photographic emulsion layer and other hydrophilic colloid layers in the light-sensitive material of the present invention may contain various surface active agents for various purposes, for example, as coating aids, or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid saponin), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonate salts, alkylbenzenesulfonate salts, alkylnaphthalenesulfonate salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts* (edited by Schoufeldt N. Pergamon Press, 1969). Among the nonionic surface active agents described in the above-mentioned references, those capable of satisfying the above-described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agents, etc.

If necessary, two or more layers may be coated at the same time by the method as described in U.S. Pat. No. 2,761,791 and British Pat. No. 837,095.

Various means for exposure can be used in the present invention. Latent images are obtained by imagewise exposure by radiant rays including visible rays. Generally, light sources used in this invention include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful.

As the heating means, a simple heat plate, iron, heat roller, heat generator utilizing carbon or titanium white, etc., or analogues thereto may be used.

In the present invention, a specific method for forming a color image by heat development comprises transfer of a hydrophilic mobile dye. For this purpose, the heat-developable color photographic material of the present invention is composed of a support having thereon a light-sensitive layer (I) containing at least silver halide, if necessary, an organic silver salt oxidizing agent, a dye releasing redox compound which is also a reducing agent for the organic silver salt oxidizing agent and a binder, and a dye fixing layer (II) capable of receiving the hydrophilic diffusible dye formed in the light-sensitive layer (I).

The above-described light-sensitive layer (I) and the dye fixing layer (II) may be formed on the same support, or they may be formed on different supports, respectively. The dye fixing layer (II) can be stripped off the light-sensitive layer (I). For example, after the heat-developable color photographic material is exposed imagewise to light, it is developed by heating uniformly and thereafter the dye fixing layer (II) or the light-sensitive layer (I) is peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred on the dye fixing layer (II) by superposing the fixing material on the light-sensitive layer.

Further, there is a method wherein only the light-sensitive layer (I) is exposed imagewise to light and heated uniformly by superposing the dye fixing layer (II) on the light-sensitive layer (I).

The dye fixing layer (II) can contain, for example, a dye mordant in order to fix the dye. In the present invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the light-sensitive layer (I) and the dye fixing layer are formed on different supports.

Preferred polymer mordants used in the present invention can be polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming cobalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc., can be illustrated.

In addition, mordants disclosed in U.S. Pat. Nos. 2,675,316 and 2,882,156 can be used.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which can be observed through the transparent support is obtained.

Typical dye fixing material used in the present invention is obtained by mixing the polymer containing ammonium salt groups with gelatin and applying the mixture to a transparent support.

The transfer of dyes from the light-sensitive layer to the dye fixing layer can be carried out using a dye transfer assistant. Examples of useful dye transfer assistant include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant can be employed by wetting the image receiving layer with the transfer assistant or by incorporating it in the form of water of crystallization or microcapsules into the material.

The expression "under high temperature condition with the proviso that a hydrophilic thermal solvent is present" means under the condition that a temperature of the atmosphere in which a hydrophilic thermal solvent is present is controlled to 60° C. or higher.

Heating for the dye transfer is carried out at temperatures ranging from 60° C. to 250° C. from the standpoint of ensuring keeping quality, workability and so on to light-sensitive materials and therefore, those which can function as the hydrophilic thermal solvent within this temperature range can be properly chosen and submitted to use in the present invention. Since it is naturally required of the hydrophilic thermal solvent to be quickly molten and to help the transfer of dyes and further, it should take into account the heat resisting property of the light-sensitive material and so on, a melting point required of the hydrophilic thermal solvent should range from 40° C. to 250° C., preferably from 40° C. to 200° C., and more preferably from 40° C. to 150° C.

"Hydrophilic thermal solvent" used in the present invention is defined as the compound which is, though in a state of solid at ordinary temperatures, transformed into liquid by heating, has an (inorganicity/organicity) value of greater than 1 and that, has the solubility of 1 or more in water at ordinary temperatures. Both the inorganicity and the organicity employed herein are conceptions introduced for predicting an attribute of the compound, and details thereof are described in, e.g., *Kagaku no Ryōiki*, vol. 11, p. 719 (1957).

Desirable hydrophilic thermal solvents are considered to be such compounds as to act solvently on hydrophilic dyes, because their role is to help the transfer of the hydrophilic dyes.

It is known empirically that solvents used preferably for dissolving a given organic compound are, in general, those having (inorganicity/organicity) values close to the (inorganicity/organicity) value of said organic compound. On the other hand, (inorganicity/organicity) values of the dye-providing compounds which can be employed in the present invention are about 1, and the hydrophilic dyes released from these dye-providing compounds have (inorganicity/organicity) values larger than those of said dye-providing compounds, preferably not smaller than 1.5, and particularly preferably not smaller than 2. Since hydrophilic thermal solvents which can be employed to advantage in the present invention are those which cannot transfer the dye-providing compounds though they can transfer the hydrophilic dyes alone, it is required of the hydrophilic thermal solvents to possess (inorganicity/organicity) values larger than those of the dye-providing compounds. Specifically, it is an indispensable codition for the hydrophilic thermal solvent to possess an (inorganicity/organicity) value of 1 or more, preferably 2 or more.

On the other hand, it is considered to be desirable from the viewpoint of molecular size that molecules which themselves are mobile and that, do not hinder the transfer of dyes are present around the moving dyes. Therefore, small molecular weights not exceeding about 200, particularly about 100, are desirable for hydrophilic thermal solvents.

If hydrophilic thermal solvents used in the present invention can give a practical aid to the transfer of hydrophilic dyes, which are produced by heat development, into a dye-fixing layer, they answer the present purpose. Accordingly, not only all of the hydrophilic thermal solvent required can be incorporated in the dye-fixing layer, but also part of the hydrophilic thermal solvent necessary for the dye transfer can be incorporated in the light-sensitive material. Further, an independent layer containing the hydrophilic thermal solvent can be provided in the independently produced dye-fixing material having the dye-fixing layer. It is to be desired from the standpoint of heightening the efficiency of dye transfer into a dye-fixing layer that the hydrophilic thermal solvent should be incorporated in the dye-fixing layer and/or the adjacent layers thereto.

The hydrophilic thermal solvent is dissolved generally in water, and dispersed into a binder. Also, it may be dissolved in alcohols, e.g., methanol, ethanol, etc.

The hydrophilic thermal solvent which can be used in the present invention can have a coverage corresponding to 5 to 500% by weight, preferably 20 to 200% by weight, and particularly preferably 30 to 150% by weight, of the whole coverage of the light-sensitive material and/or the dye-fixing material.

Suitable examples of the hydrophilic thermal solvent which can be used in the present invention include areas, pyridines, amides, sulfonamides, imides, alcohols, oximes and other heterocyclic rings.

Specific examples of the hydrophilic thermal solvent which can be used in the present invention are illustlated below.

$H_2N\overset{O}{\overset{\|}{C}}NH_2$, (1)

$H_2N\overset{O}{\overset{\|}{C}}NHCH_3$ (2)

-continued $H_2N\overset{O}{\overset{\|}{C}}NHC_2H_5$, (3)

$CH_3NH\overset{O}{\overset{\|}{C}}NHCH_3$ (4)

$HOCH_2NH\overset{O}{\overset{\|}{C}}NH_2$ (5)

$HOCH_2NH\overset{O}{\overset{\|}{C}}NHCH_2OH$ (6)

$HOC_2H_4NH\overset{O}{\overset{\|}{C}}NHC_2H_4OH$ (7)

$H_2N\overset{O}{\overset{\|}{C}}NHC_2H_4OH$ (8)

$H_2N\overset{O}{\overset{\|}{C}}N(C_2H_4OH)_2$ (9)

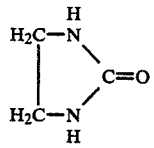
(10)

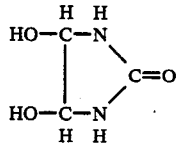
(11)

$H_2N-\overset{O}{\overset{\|}{C}}-N(CH_3)_2$ (12)

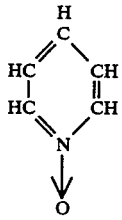
(13)

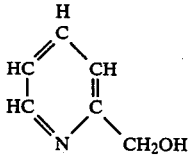
(14)

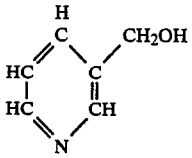
(15)

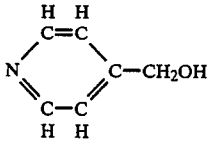
(16)

-continued
(17)
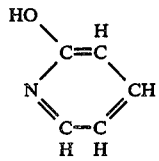
(18)
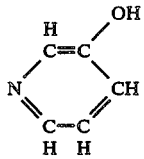
(19)
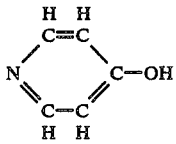
(20)
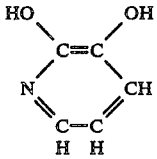
(21)
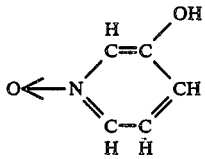
(22)
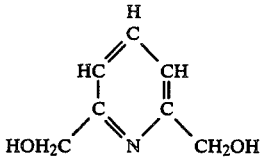
(23)
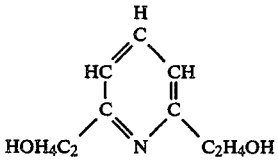
(24)
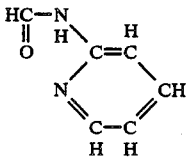
(25)
$(HCNH)_2CH_2$,
(26)
$CH_3CNH_2$
(27)
$(CH_3CNH)_2CH_2$,
-continued
(28)
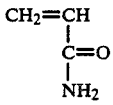
(29)
$HOC_2H_4CNH_2$,
(30)
$HOCH_2CNH_2$
(31)
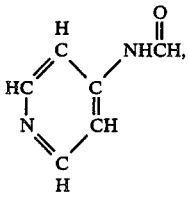
(32)
$NCCH_2CNH_2$
(33)
$(CH_3)CH-C-NH_2$
$CH_3SO_2NH_2$, (34)
$HOCH_2SO_2NH_2$ (35)
$H_2NSO_2NH_2$, (36)
$_3HCNHSO_2NH_2$ (37)
$HOCH_2SO_2$ , (38)
$NHCH_3$
$(CH_3)_2N$ (39)
$SO_2NH_2$
(40)
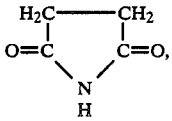
(41)
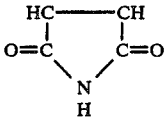
(42)
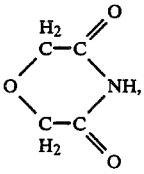
(43)
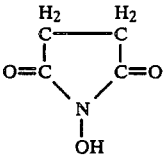
(44)
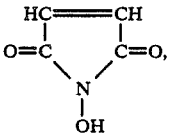

-continued

(45) $(CH_3CO)_2NH$ (46)

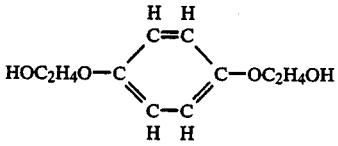

(47) $HOCH_2(CHOH)_3CH_2OH$,
(48) $CH_3C(CH_2OH)_3$,
(49) $C_2H_5C(CH_2OH)_3$
(50) $O_2NC(CH_2OH)_3$,
(51) sorbitol (52)

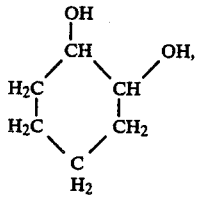

(53)

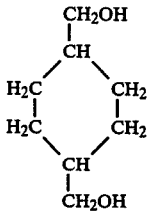

(54) $HOCH_2-CH=CH-CH_2OH$
(55) $CH_3CH=NOH$,
(56) $HON=CHCH=NOH$

(57) $CH_3C(=NOH)-CH_3C=O$

(58) $HOCH_2CH=NOH$ (59)

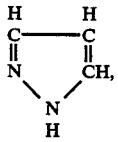

(60)

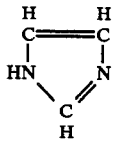

(61)

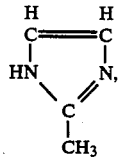

(62)

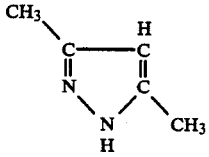

The present invention will now be illustrated in more detail by reference to the following examples. However, the present invention should not be construed as being limited to these examples in any way.

EXAMPLE 1

In 3,000 ml of water were dissolved 40 g of gelatin and 26 g of KBr. This solution was kept at 50° C. with stirring and thereto, a solution prepared by dissolving 34 g of silver nitrate in 200 ml of water was added over a 10-minute period.

Thereafter, a solution containing 3.3 g of KI dissolved in 100 ml of water was added over a 2-minute period to the above-described reaction mixture.

The thus obtained silver iodobromide emulsion was controlled to proper pH to cause sedimentation and thereby, excess salt was removed from the emulsion. Thereafter, pH of the emulsion was adjusted to 6.0. Thus, the silver iodobromide emulsion was obtained with a yield of 400 g.

Next, a gelatin dispersion of the dye-providing compound was prepared in the manner described below.

5 g of the magenta Dye Releasing Redox Compound (3), 0.5 g of 2-ethylhexyl sodium sulfosuccinate as a surface active agent, and 5 g of tricresyl phosphate were weighed out and thereto, 30 ml of ethyl acetate was added. They were dissolved by heating to about 60° C. to form a homogeneous solution. The resulting solution and 100 g of a 10% solution of lime-processed gelatin were mixed together with stirring, and dispersed for 10 minutes using a homogenizer rotating at 10,000 r.p.m. The thus obtained dispersion was called the dispersion of the magenta dye-providing compound.

Then, a light-sensitive coated material was prepared in the following manner.

(a) Light-sensitive Silver Iodobromide Emulsion: 25 g
(b) Dispersion of Dye-providing Compound: 33 g
(c) 5% Water Solution of the Following Compound: 10 ml

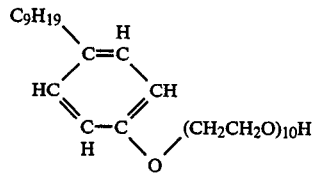

(d) 10% Water Solution of $H_2N-SO_2N(CH_3)_2$: 4 ml
(e) 10% Ethanol Solution of Guanidinotrichloroacetic Acid: 15 ml The above-described ingredients are mixed, and dissolved by heating. The resulting coating composition was coated on a 180 μm-thick polyethylene terephthalate film in a wet thickness of 30 μm. Further thereon, the following composition was coated as a protective layer.

(a) 10% Water Solution of Gelatin: 35 g
(b) 10% Ethanol Solution of Guanidinotrichloroacetic Acid: 6 ml
(c) 1% Water Solution of 2-Ethylhexyl Sodium Sulfosuccinate: 4 ml
(d) Water: 55 ml The above-described ingredients were mixed and coated in a wet thickness of 25 μm. After drying this coated sample, said sample was exposed imagewise by means of a tungsten lamp under illuminance of 2,000 lux for 10 seconds and then, heated uniformly on 140° C. hot block for 60 seconds.

Separately, a dye-fixing material containing a dye-fixing agent was prepared in the following manner.

In 200 ml of water was dissolved 10 g of poly(methylacrylate-co-N,N,N-trimethyl-N-vinylbenzylammonium chloride) (ratio of methylacrylate to vinylbenzylammonium chloride=1:1). The resulting solution was mixed homogeneously with 100 g of a 10% water solution of lime-processed gelatin, and this mixture was uniformly coated in a wet thickness of 90 μm on a 120 μm-thick polyethylene terephthalate film into which titanium oxide had been dispersed in advance.

On the layer containing the above-described dye-fixing agent, a solution prepared by dissolving 4 g of urea in 10 ml of water and then, by mixing homogeneously with 12 g of a 10 wt% solution of polyvinyl alcohol (having a saponification degree of 98%) (,which was called Solution (A)) was uniformly coated in a wet thickness of 60 μm. After drying this coated sample, said sample was used as the dye-fixing material (Sheet A). Another solution was prepared in the same manner as Solution (A) except that adsorptive Compound (43) of the present invention was additionally used in an amount of 0.3 g, and according to the same procedures as described above, another dye-fixing material (Sheet B) was obtained.

Compound (43)

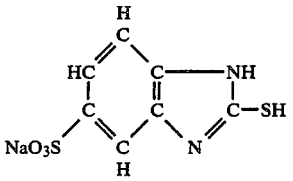

The foregoing light-sensitive material which had received the heat treatment and the dye-fixing material were so superposed as to come into a face-to-face contact with each other, and heated for 40 seconds on 140° C. hot block. Then, the dye-fixing material was peeled off the light-sensitive material. Thus, negative magenta dye image was obtained on the dye-fixing material. Densities of these negative images were measured with a Macbeth reflection densitometer (RD-519). The results obtained are set forth below.

| Dye-fixing Material | Maximum Density | Minimum Density |
|---|---|---|
| Sheet A (Comparison) | 2.23 | 0.53 |
| Sheet B (This Invention) | 2.18 | 0.18 |

The above-described results demonstrate that clear image having low minimum density and high maximum density can be obtained by using the dye-fixing material of the present invention.

EXAMPLE 2

The following data was obtained by carrying out the same procedures as in Example 1 except that each of the compounds set forth in the following table was additionally used in Solution (A).

| Sample | Adsorption Compound No., Structure thereof, and Amount used | | Maximum Density | Minimum Density |
|---|---|---|---|---|
| (C) | (7) (1 g) | 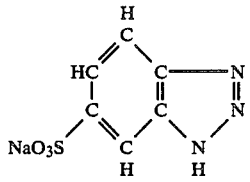 | 2.18 | 0.19 |
| (D) | (42) (0.3 g) | 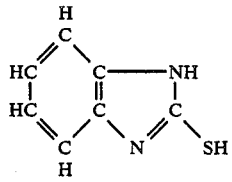 | 2.22 | 0.19 |
| (E) | (45) (0.3 g) | 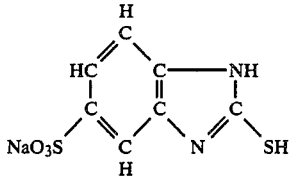 | 2.18 | 0.19 |
| (F) | (52) (0.5 g) | 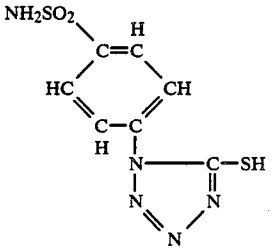 | 2.22 | 0.20 |
| (G) | (60) (0.3 g) | 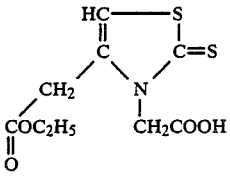 | 2.15 | 0.18 |
| (H) | (63) (0.3 g) | 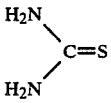 | 2.20 | 0.16 |
| (I) | (64) (0.3 g) | 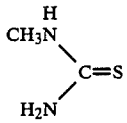 | 2.20 | 0.16 |
| (J) | (67) (0.3 g) | 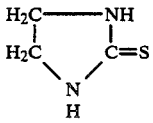 | 2.18 | 0.18 |
| (K) | (70) (0.3 g) | 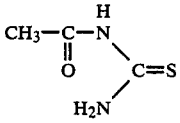 | 2.16 | 0.17 |

-continued

| Sample | Adsorption Compound No., Structure thereof, and Amount used | Maximum Density | Minimum Density |
|---|---|---|---|
| (L) | (5) (0.3 g) 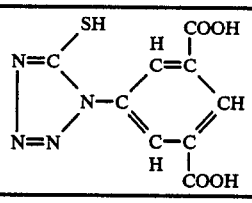 | 2.18 | 0.16 |

The above-described results demonstrate that image of excellent quality can be obtained by using the dye-fixing materials of the present invention.

EXAMPLE 3

Dispersions of dye-providing compounds were prepared in the same manner as in Example 1 except that the following dye-providing compounds were employed respectively in place of the Dye Releasing Redox Compound (3) used in Example 1.

Dye Releasing Redox Compound (1): 5 g
Dye Releasing Redox Compound (4): 7.5 g
Dye Releasing Redox Compound (2): 5 g Samples were produced according to the same procedure as in Example 1, and subjected to the same processings as in Example 1. Results obtained are shown below.

| Dispersion of Dye-providing Compound | Dye-fixing Material | Maximum Density | Minimum Density |
|---|---|---|---|
| Dispersion of (1) (magenta) | Sheet A (comparison) | 2.24 | 0.57 |
| | Sheet B (this invention) | 2.20 | 0.20 |
| Dispersion of (4) (yellow) | Sheet A (comparison) | 2.05 | 0.43 |
| | Sheet B (this invention) | 2.00 | 0.18 |
| Dispersion of (2) (cyan) | Sheet A (comparison) | 2.28 | 0.62 |
| | Sheet B (this invention) | 2.28 | 0.21 |

The above-described data demonstrate that clear image having low minimum density and high maximum density can be obtained by using the dye-fixing material of the present invention.

EXAMPLE 4

The case in which an organic silver salt type oxidizing agent was used is illustrated below.

An emulsion of benzotriazolylsilver was prepared in a manner as described below.

A solution prepared by dissolving 28 g of gelatin and 13.2 g of benzotriazole in 3,000 ml of water was stirred with keeping at 40° C., and thereto was added a solution containing 17 g of silver nitrate in 100 ml of water over a 2-minute period.

The thus obtained benzotriazolylsilver emulsion was controlled to proper pH so as to cause sedimentation and thereby, excess salt was removed from the emulsion. Thereafter, pH of the emulsion was adjusted to 6.0. Thus, the intended benzotriazolylsilver emulsion was obtained with a yield of 400 g.

A light-sensitive coating composition containing said benzotriazolylsilver emulsion was prepared as follows.

(a) Silver Iodobromide Emulsion (as described in Example 1): 20 g
(b) Benzotriazolylsilver Emulsion: 10 g
(c) Same Dispersion of Dye-providing Compound as employed in Example 1: 33 g
(d) 5% Water Solution of Following Compound: 10 ml

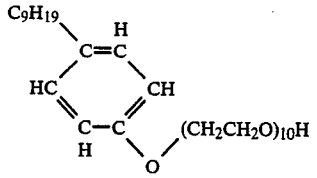

(e) 10% Water Solution of $H_2N\text{-}SO_2N(CH_3)_2$: 4 ml
(f) 10% Ethanol Solution of Guanidinotrichloroacetic Acid: 15 ml The above-described ingredients (a) to (f) were admixed with one another. Using this mixture, samples were produced according to the same procedure as in Example 1, and subjected to the same processings as in Example 1. Results obtained are shown below.

| Sample | Maximum Density | Minimum Density |
|---|---|---|
| A (Comparison) | 2.26 | 0.51 |
| B (This Invention) | 2.21 | 0.17 |

The above-described data demonstrate that clear image having low minimum density and high maximum density can be obtained by using the dye-fixing material of the present invention.

EXAMPLE 5

In 200 ml of water was dissolved 10 g of poly(methylacrylate-co-N,N,N-trimethyl-N-vinylbenzylammonium chloride) (ratio of methylacrylate to vinylbenzylammonium chloride=1:1). The solution was mixed homogeneously with 100 g of a 10% water solution of lime-processed gelatin, and this mixture was uniformly coated in a wet thickness of 90 μm on a 120 μm-thick polyethylene terephthalate film into which titanium oxide had been dispersed in advance.

On the layer containing this dye-fixing agent, a solution prepared by dissolving 4 g of urea in 10 ml of water and then, by mixing homogeneously with 12 g of a 10% solution of polyvinyl alcohol (having a saponification degree of 98%) (, which was called Solution (A)) was uniformly coated in a wet thickness of 60 μm. After drying this coated sample, said sample was used as the dye-fixing material (Sheet A). Another solution was prepared in the same manner as Solution (A) except that adsorptive Compound (43) of the present invention was additionally used in an amount of 0.05 (Solution L), and another dye-fixing material (Sheet L) was obtained according to the same procedure as described above.

Then, the same light-sensitive material as in Example 1 was exposed imagewise by means of a tungsten lamp under illuminance of 2,000 lux for 10 seconds. The thus exposed light-sensitive material and the above-described dye-fixing material were so superposed as to come into a face-to-face contact with each other, and heated for 50 seconds on 130° C. hot block. Thereafter, the dye-fixing material was peeled off the light-sensitive material. Thus, negative magenta color image was obtained on the dye-fixing material. Densities of these negative images were measured with a Macbeth reflection densitometer (RD-519). The data obtained are shown below.

| Dye-fixing Material | Maximum Density | Minimum Density |
|---|---|---|
| Sheet A (Comparison) | 2.20 | 0.60 |
| Sheet L (This Invention) | 2.10 | 0.21 |

The foregoing data demonstrate that excellent image can be obtained by using the dye-fixing material of the present invention.

EXAMPLE 6

The same light-sensitive material as prepared in Example 4 and the same dye-fixing material as prepared in Example 5 were employed, and they were subjected to the same processings as in Example 5. Densities of the negative image formed on the dye-fixing material were measured with a Macbeth reflection densitometer (RD-519), and data set forth below were obtained.

| Dye-fixing Material | Maximum Density | Minimum Density |
|---|---|---|
| Sheet A (Comparison) | 2.23 | 0.50 |
| Sheet L (This Invention) | 2.14 | 0.19 |

The above-described results demonstrate that excellent image can be obtained by using the dye-fixing material of the present invention.

EXAMPLE 7

On the layer having the same dye-fixing agent as used in Example 1 was uniformly coated in a wet thickness of 60 μm each of solutions prepared by mixing the following ingredients (a) to (f) (, which were named Solutions M, N, O, P and Q respectively depending on the difference in ingredient (f) used). The coated samples were dried to form dye-fixing materials (Sheets M, N, O, P and Q, respectively).

(a) Water: 10 ml (b) 10 wt% Water Solution of Polyvinyl Alcohol having Saponification Degree of 98%: 12 g (c) Compound of Following Structural Formula: 100 mg

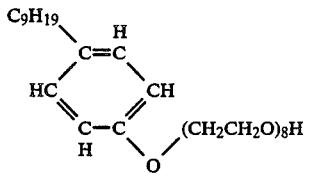

(d) 5% Water Solution of Sodium Dodecylbenzenesulfonate: 0.5 ml (e) adsorptive Compound (43) of Present Invention: 1 g The above-described ingredients (a) to (e) were common to all Solutions M, N, O, P and Q, and hydrophilic thermal solvents employed as the ingredient (f) were as follows.

| | | |
|---|---|---|
| M: | Pyridine N—oxide | 4 g |
| N: | Sulfonamide | 4 g |
| O: | Acetamide | 4 g |
| P: | Urea | 2 g |
| | N—Methylurea | 2 g |
| Q: | Urea | 1 g |
| | N—Methylurea | 1 g |
| | Ethyleneurea | 1 g |
| | Ethylurea | 1 g |

The same light-sensitive material as prepared in Example 4 was exposed imagewise by means of a tungsten lamp under illuminance of 2,000 lux for 10 seconds and then, heated uniformly for 20 seconds on hot block heated to 140° C. The thus heated light-sensitive material and each of the above-described dye-fixing materials were so superposed as to come into a face-to-face contact with each other, and heated for 40 seconds on 140° C. hot block. Thereafter, the dye-fixing material was peeled off the light-sensitive material. Thus, negative magenta image was obtained on each dye-fixing material. Densities of these negative images were measured with a Macbeth reflection densitometer (RD-519), and the following date was obtained.

| Dye-fixing Material | Maxiumum Density | Minimum Density |
|---|---|---|
| M | 2.20 | 0.18 |
| N | 2.35 | 0.20 |
| O | 2.05 | 0.16 |
| P | 2.34 | 0.20 |
| Q | 2.36 | 0.22 |

As can be seen from the foregoing table, images having low minimum density and high maximum density are obtained by using the dye-fixing materials of the present invention.

EXAMPLE 8

In 3,000 ml of water were dissolved 40 g of gelatin and 26 g of KBr. This solution was stirred as its temperature was kept at 50° C. Thereto, a solution prepared by dissolving 34 g of silver nitrate in 200 ml of water was added over a 10-minute period and subsequently, a solution prepared by dissolving 3.3 g of KI in 100 ml of water was further added over 2-minute period.

The thus obtained silver iodobromide emulsion was controlled to proper pH to cause sedimentation and thereby, excess salt was removed from the emulsion. Thereafter, pH of the emulsion was adjusted to 6.0. Thus, the intended silver iodobromide emulsion was obtained with a yield of 400 g.

An emulsion of benzotriazolylsilver was prepared in a manner as described below.

A solution prepared by dissolving 28 g of gelatin and 13.2 g of benzotriazole in 3,000 ml of water was stirred as the solution was kept at 40° C. and thereto, a solution prepared by dissolving 17 g of silver nitrate in 100 ml of water was added over a 2-minute period.

The thus obtained benzotriazolylsilver emulsion was controlled to proper pH so as to cause sedimentation and thereby, excess salt was removed from the emulsion. Thereafter, pH of the emulsion was adjusted to 6.0. Thus, the intended benzotriazolylsilver emulsion was obtained with a yield of 400 g.

Next, a gelatin dispersion of the dye-providing compound was prepared in the manner as described below.

10 g of the Dye-providing Compound (1), 0.05 g of 2-ethylhexyl sodium sulfosuccinate as a surface active agent, and 10 g of tricresyl phosphate were weighed out and thereto, 20 ml of cyclohexanone was added. They were dissolved by heating to about 60° C. to form a homogenous solution. The resulting solution and 100 g of a 10% solution of lime-processed gelatin were mixed together with stirring and then, dispersed for 10 minutes by means of a homogenizer rotating at 10,000 r.p.m. The thus obtained dispersion was called the dispersion of the magenta dye-providing compound.

Then, a light-sensitive coated material was produced as follows.

(a) Silver Iodobromide Emulsion: 2 g
(b) Benzotriazolylsilver Emulsion: 5 g
(c) 10% Gelatin Water Solution: 2 g
(d) Gelatin Dispersion of Dye-providing Compound (1): 12.5 g
(e) 10% Ethanol Solution of Guanidinotrichloroacetic Acid: 0.5 ml
(f) 10% Methanol Solution of 2,6-Dichloro-4-aminophenol: 0.5 ml
(g) 5% Water solution of Compound having Following Structural Formula: 10 ml

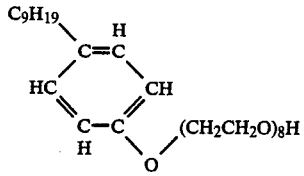

(h) Water: 4.5 ml

The above-described ingredients (a) to (h) were mixed, and dissolved by heating. The resulting composition was coated on a 180 μm-thick polyethylene terephthalate film in a wet thickness of 85 μm. Further thereon, a gelatin layer having a coverage of 1.5 g/m$^2$ was provided as a protective layer. Thus, the intended light-sensitive material E-1 was produced.

In addition, dye-fixing materials having the dye-fixing agent were formed in the following manner.

In 200 ml of water was dissolved 10 g of poly(methylacrylate-co-N,N,N-trimethyl-N-vinylbenzylammonium chloride) (ratio of methylacrylate to vinylbenzylammonium chloride=1:1). The resulting solution was mixed homogeneously with 100 g of a 10% water solution of lime-processed gelatin, and this mixture was uniformly coated in a wet thickness of 90 μm on a 120 μm-thick polyethylene terephthalate film into which titanium oxide had been dispersed.

Further thereon, the composition prepared by mixing and dissolving the following ingredients (a) to (f) was uniformly coated in a wet thickness of 70 μm, and dried to form a dye-transfer assisting layer. The thus obtained sample was used as a dye-fixing material (Sheet A).

[COMPOSITION A]

(a) Urea: 2 g
(b) N-Methylurea: 2 g
(c) Water: 10 ml
(d) 10wt% Water Solution of Polyvinyl Alcohol having Saponification degree of 98%: 12 g
(e) Compound having Following Structural 100 mg Formuls:

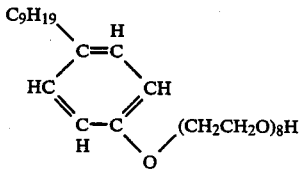

(f) 5% Water Solution of Sodium Dodecylbenzenesulfonate: 0.5 ml

Another solution was prepared in the same manner as the composition A except that adsorption Compound (43) of the present invention and having the followiing structural formula was additionally used in an amount of 0.3 g (Composition B), and another dye-fixing material (Sheet B) was obtained according to the same procedures as described above.

Compound (43)

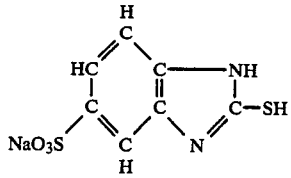

The light-sensitive material E-1 was exposed imagewise by means of a tungsten lamp under illuminance of 2,000 lux for 10 seconds and then, it was uniformly heated for 40 seconds on 140° C. hot block.

Next, each of the dye-fixing materials (Sheet A and Sheet B) and the light-sensitive material which had received the heat development were so superposed as to come into a face-to-face contact with each other, and heated for 30 seconds on 120° C. hot block.

Then, the dye-fixing material was peeled off the light-sensitive material. Thus, negative magenta color image was obtained on the dye-fixing material. Densities of these negative images were measured with a Macbeth reflection densitometer (RD-517). The data obtained are set forth below.

| Dye-fixing Material | Maximum Density | Minimum Density |
|---|---|---|
| Sheet A (Comparison) | 2.20 | 0.52 |
| Sheet B (This Invention) | 2.17 | 0.19 |

The above-described results demonstrate that image having low minimum density and high maximum density can be obtained by using the dye-fixing material of the present invention.

EXAMPLE 9

A light-sensitive material E-2 was produced in the following manner.

In the first place, an emulsion of Coupler (M-1) having the structural formula illustrated below was prepared as follows.

To 100 g of a 10% water solution of gelatin which was dissolved at 40° C. was added 0.5 g of sodium dodecylbenzenesulfonate. The resulting mixture was dissolved by stirring. 10 g of Coupler (M-1) of the present invention, 10 g of tricresyl phosphate and 20 ml of ethyl acetate were mixed and dissolved by heating. The thus obtained surface active agent-containing gelatin solution and coupler solution were dispersed in a form of emulsion using a homogenizer rotating at 12,000 r.p.m. for 3 minutes. Thus, the intended coupler emulsion was obtained.

(M-1)

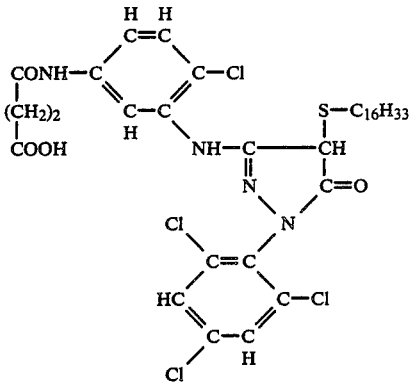

(Light-sensitive Composition)

(a) Silver Iodobromide Emulsion (the same as prepared in Example 8): 5.5 g
(b) 10% Water Solution of Gelatin: 2 g
(c) Dispersion of Coupler (M-1): 2.5 g
(d) 10% Ethanol Solution of Guanidinotrichloracetic Acid: 0.5 ml
(e) 10% Ethanol Solution of 2,6-dichloro-4-aminophenol: 0.5 ml
(f) 5% Water Solution of Compound having Following Structural Formula: 1 ml

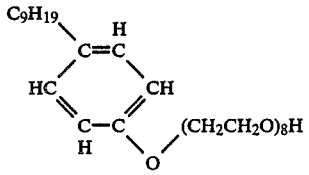

(g) Water: 6 ml

The above-described ingredients (a) to (g) were mixed, and dissolved by heating to prepare the light-sensitive composition. This composition was coated in a wet thickness of 85 μm on a 180 μm-thick polyethylene terephthalate film. Furthere thereon, gelatin was coated at a coverage of 1.5 g/m$^2$ as a protective layer. Thus, the sensitive material E-2 was obtained.

The above-described light-sensitive material E-2 was exposed imagewise by means of a tungsten lamp under illuminance of 2,000 lux for 10 seconds and thereafter, it was uniformly heated for 30 seconds on hot block heated up to 130° C.

The thus processed light-sensitive material and the same dye-fixing material as prepared in Example 8 (Sheet A or Sheet B) were so superposed as to come into a face-to-face contact with each other, and heated for 30 seconds on 120° C. hot block.

Then, the dye-fixing material was peeled off the light-sensitive material. Thus, negative magenta color image was obtained on the dye-fixing material.

Densities of these negative images were measured with a Macbeth reflection densitometer (RD-519), and the following data were obtained.

| Dye-fixing Material | Maximum Density | Minimum Density |
|---|---|---|
| Sheet A (Comparison) | 2.25 | 0.60 |
| Sheet B (This Invention) | 2.20 | 0.21 |

The above-described results demonstrate that image having low minimum density and high maximum density can be obtained by using the dye-fixing material of the present invention.

EXAMPLE 10

A light-sensitive material E-3 was produced in the following manner.

In the first place, a dispersion of the dye-providing compound was prepared as follows.

5 g of the reductant of Dye-providing Compound IA-(9) having the structural formula illustrated below, 0.5 g of 2-ethylhexyl sodium sulfosuccinate and 15 g of tricresyl phosphate were weighed out, and admixed with 30 ml of ethyl acetate and dissolved therein by heating at 60° C. The resulting homogeneous solution was mixed with 100 g of a 10% solution of lime-processed gelatin with stirring and thereafter, dispersed for 10 minutes by means of a homogenizer rotating at 10,000 r.p.m. The thus obtained dispersion of the dye-providing compound was called Dispersion DP-1.

(IA-9)

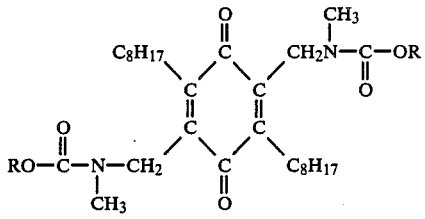

wherein R is

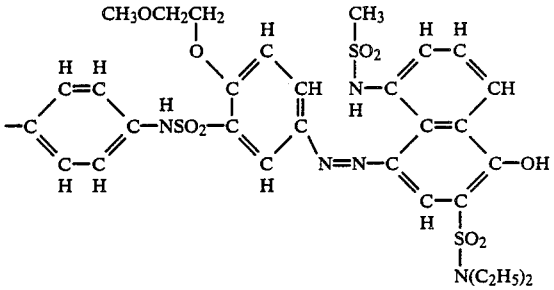

Next, a light-sensitive coated material was prepared in the following manner.

(a) Light-sensitive Silver Iodobromide Emulsion (as described in Example 8): 25 g
(b) Dispersion DP-1 of Dye-providing Compound: 33 g
(c) 10% Ethanol Solution of Guanidinotrichloroacetic Acid: 15 ml
(d) 2.5% Water Solution of Compound illustrated below: 10 ml

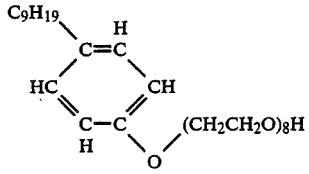

(e) 10% Water Solution of N,N-Dimethylsulfonamide: 4 ml

After the above-described ingredients (a) to (e) were admixed and dissolved, it was coated on a polyethylene terephthalate film in a wet thickness of 30 μm, and dried.

Further thereon, the coating composition containing the following ingredients (f) to (i) was coated as a protective layer in a wet thickness of 25 μm, and dried to produce the intended light-sensitive material E-3.

(f) 10% Water Solution of Gelatin: 35 g
(g) 10% Ethanol Solution of Guanidinotrichloroacetic Acid: 6 ml
(h) 1% Water Solution of Sodium Sulfonate: 4 ml
(i) Water: 55 ml The thus produced light-sensitive material E-3 was exposed imagewise by means of a tungsten lamp under illuminance of 2,000 lux for 10 seconds and then, heated uniformly for 30 seconds on hot block heated up to 130° C.

The thus processed light-sensitive material and the same dye-fixing material as prepared in Example 8 (Sheet A or Sheet B) were so superposed as to come into a face-to-face contact with each other, and heated for 30 seconds on 120° hot block. Then, the dye-fixing material was peeled off the light-sensitive material. Thus, positive magenta color image was obtained on the dye-fixing material. Densities of these positive images were measured with a Macbeth reflection densitometer (RD-519), and the following data were obtained.

| Dye-fixing Material | Maximum Density | Minimum Density |
|---|---|---|
| Sheet A (Comparison) | 2.42 | 0.98 |
| Sheet B (This Invention) | 2.35 | 0.35 |

The above-described results demonstrate that image having low minimum density and high maximum density can be obtained by using the dye-fixing material of the present invention.

EXAMPLE 11

A light-sensitive material E-4 was produced in the following manner.

To 5 g of the foregoing Dye-providing Compound IA-(9), 4 g of the electron donating compound ED-(22) having the structural formula illustrated below, 0.5 g of 2-ethylhexyl sodium sulfossuccinate and 10 g of tricresyl phosphate was added 20 ml of cyclohexanone. The resulting mixture was dissolved by heating at 60° C. The thus prepared solution and 100 g of a 10% gelatin solution were mixed with stirring, and dispersed for 10 minutes by means of a homogenizer rotating at 10,000 r.p.m. The resulting dispersion of the dye-providing compound was called Dispersion DP-2.

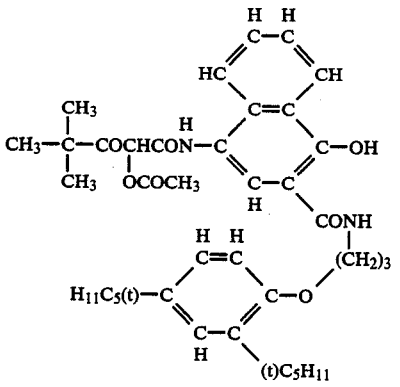

Next, a light-sensitive coated material was prepared in the following manner.

(a) Light-sensitive Silver Iodobromide Emulsion (as described in Example 8): 25 g
(b) Dispersion DP-2 of Dye-providing Compound: 33 g
(c) 10% Ethanol Solution of Guanidinotrichloroacetic Acid: 15 ml
(d) 2.5% Water Solution of Compound illustrated below: 10 ml

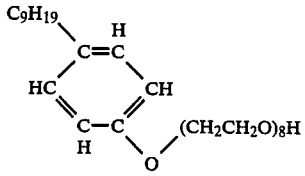

(e) 10% Water Solution of N,N-Dimethylsulfonamide: 4 ml

After the above-described ingredients (a) to (e) were admixed together with 2 ml of water and dissolved by heating, it was coated on a polyethylene terephthalate film in a wet thickness of 60 μm, and dried.

Further thereon, the coating composition containing the following ingredients (a) to (d) was coated as a protective layer in a wet thickness of 25 μm, and dried to produce the intended light-sensitive material E-4.

(a) 10% Water Solution of Gelatin: 35 g
(b) 10% Ethanol Solution of Guanidinotrichloroacetic Acid: 6 ml
(c) 1% Water Solution of 2-Ethylhexyl Sodium Sulfosuccinate: 4 ml
(d) Water: 55 ml The thus produced light-sensitive material E-4 was exposed imagewise by means of a tungsten lamp under illuminance of 2,000 lux for 10 seconds.

Then, the thus exposed light-sensitive material and the same dye-fixing material as prepared in Example 8 (Sheet A or Sheet B) were so superposed as to come into a face-to-face contact with each other, and heated for 30 seconds on 120° C. hot block. Thereafter, the dye-fixing material was peeled off the light-sensitive material. Thus, positive magenta color image was obtained on the dye-fixing material. Densities of these positive images were measured with a Macbeth reflection densitometer (RD-519), and the following data were obtained.

| Dye-fixing Material | Maximum Density | Minimum Density |
|---|---|---|
| Sheet A (Comparison) | 2.50 | 0.80 |
| Sheet B (This Invention) | 2.40 | 0.28 |

The above-described results demonstrate that image of low minimum density and high maximum density can be obtained by using the dye-fixing material of the present invention.

While the invention has been described in detail and with reference to specific embodiment thereof, it will be apparent to one skilled in the art that various changes and modifications can be made therein without departing from the spirit and scope thereof.

What is claimed is:

1. A method for forming images which comprises forming a mobile hydrophilic dye in an imagewise distribution by exposing to an imagewise pattern of light, and subsequently or simultaneously heat-developing, a heat developable light-sensitive material comprising at least a light-sensitive silver halide, a binder and a dye providing substance, wherein said heat developable light-sensitive material is provided on a support capable of forming the hydrophilic dye by the reaction with a light-sensitive silver halide upon heating under a substantially water-free condition, and subsequently transferring and fixing said mobile hydrophilic dye, by heating in the presence of a hydrophilic thermal solvent, on a single or multiple dye-fixing layer which contains at least a dye-fixing agent and a compound capable of reacting with or absorbing a silver halide, wherein said dye-fixing layer is provided on a distinct support from the support for said heat developable light-sensitive material, and wherein said compound is a 5- or 6-membered nitrogen-containing heterocyclic compound selected from the group consisting of the following formula (III) to (XVI) or a thiourea compound represented by the following formula (XVII):

(III)

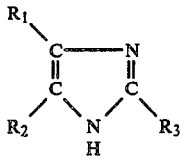

(IV)

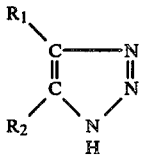

(V)

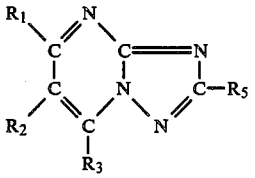

(VI)

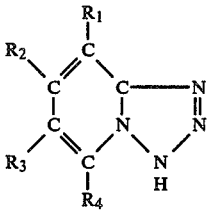

(VII)

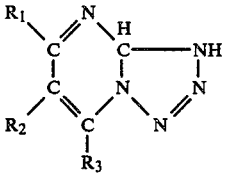

(VIII)

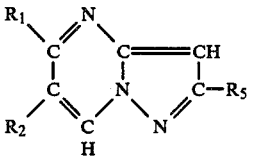

-continued (IX)

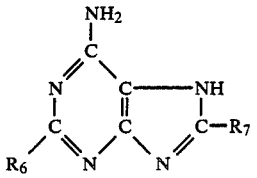

(X)

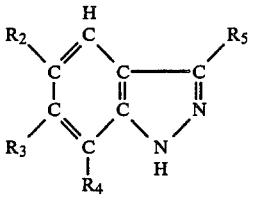

(XI)

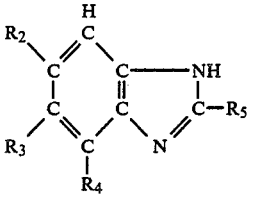

(XII)

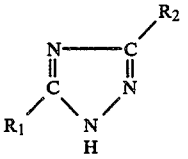

(XIII)

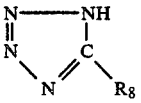

(XIV)

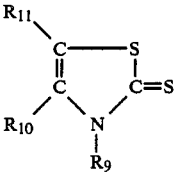

(XV)

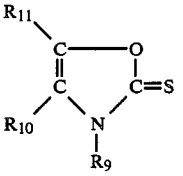

(XVI)

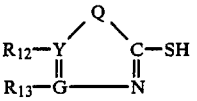

(XVII)

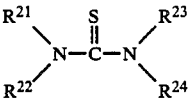

wherein $R_1$, $R_2$, $R_3$ and $R_4$ each represents a hydrogen atom, an alkyl group, an aralkyl group, an alkenyl group, an alkoxy group, an aryl group, —NRR′, —COOR, —$SO_3M$, —CONRR′, —NH-$SO_2R$, —$SO_2NRR'$, —$NO_2$, a halogen atom, —CN or a hydroxy group, wherein R and R′ each represents a hydrogen atom, an alkyl group, an aryl group or an aralkyl group, and M represents a hydrogen atom or an alkali metal atom, and when both $R_1$ and $R_2$ represent an alkyl group, they may combine with each other to form an aliphatic hydrocarbon ring;

$R_5$ represents a hydrogen atom, an alkyl group containing 1 to 5 carbon atoms, or —S—R″, wherein R″ represents a hydrogen atom, an alkyl group, an aryl group or an aralkyl group;

$R_6$ represents a hydrogen atom or an alkyl group;

$R_7$ represents a hydrogen atom, an alkyl group or an aryl group;

$R_8$ represents an alkyl group, an aryl group, a benzyl group, or a pyridyl group;

$R_9$ represents an alkyl group, an alkenyl group, or an aryl group;

$R_{10}$ and $R_{11}$ both represent an alkyl group, an alkenyl group, or an aryl group, and when both $R_{10}$ and $R_{11}$ are an alkenyl group, they may combine with each other to form an aromatic ring;

Q represents an oxygen atom, a sulfur atom or —NR‴, wherein R″ represents a hydrogen atom, an alkyl group, an unsaturated aliphatic hydrocarbon residue, or a substituted or unsubstituted aryl or aralkyl group;

Y and G each represents a carbon atom or a nitrogen atom;

$R_{12}$ and $R_{13}$ each represents a hydrogen atom, an alkyl group, an unsaturated aliphatic hydrocarbon residue, a substituted or unsubstituted aryl group, substituted or unsubstituted aralkyl group, —SR⁗ or —$NH_2$, wherein R⁗ represents a hydrogen atom, an alkyl group, an aryl group, an aralkyl group, an alkylcarboxylic acid or its alkali metal salt, or an alkylsulfinic acid or its alkali metal salt, and when Y and G both represent a carbon atom they may combine with each other to form an aromatic ring; and $R^{21}$ and $R^{24}$ may be the same or different, and each represents a hydrogen atom, a substituted or unsubstituted alkyl group, a substituted or unsubstituted alkenyl group, a substituted or unsubstituted aralkyl group, a substituted or unsubstituted aryl group, a nitrogen-containing heterocyclyl group or an acyl group.

2. The method for forming images according to claim 1, wherein the compound capable of reacting with or absorbing a silver halide is a development stopper, antifoggant, or both.

3. The method for forming images according to claim 2, wherein said compound is contained in a dye-fixing layer of a dye-fixing material.

4. The method for forming images according to claim 1, wherein the amount of the compound capable of reacting with or absorbing a silver halide is from 1/1000 to 10 mols based on 1 mol of silver.

5. The method for forming images according to claim 1, wherein the heating for fixation of the mobile hydrophilic dye to the dye-fixing layer takes place after said heat-development.

6. The method for forming images according to claim 1, wherein the hydrophilic thermal solvent is contained in the dye-fixing agent.

7. The method for forming images according to claim 6, wherein the ratio of inorganicity of the hydrophilic thermal solvent organicity is not less than 1.

8. The method for forming images according to claim 6, wherein the molecular weight of the hydrophilic thermal solvent is not more than 200.

9. The method for forming images according to claim 6, wherein the amount of the hydrophilic thermal solvent is 5 to 500 wt% based on a total amount of the heat developable light-sensitive material and dye-fixing material.

10. The method for forming images according to claim 9, wherein the amount of the hydrophilic thermal solvent is 20 to 200 wt% based on the total amount of the heat developable light-sensitive material and dye-fixing material.

11. A method for forming images which comprises forming a mobile hydrophilic dye in an imagewise distribution by exposing to an imagewise pattern of light, and subsequently or simultaneously heat-developing, a heat developable light-sensitive material comprising at least a light-sensitive silver halide, a binder and a dye providing substance, wherein said heat developable light-sensitive material is provided on a support capable of forming the hydrophilic dye by the reaction with a light-sensitive silver halide upon heating under a substantially water-free condition, and subsequently transferring and fixing said mobile hydrophilic dye, by heating without externally supplying a solvent, on a single or multiple dye-fixing layer which contains at least a dye-fixing agent and a compound capable of reacting with or absorbing a silver halide, and wherein said dye-fixing layer is provided on a distinct support from the support for said heat developable light-sensitive material, and wherein said compound is a 5- or 6-membered nitrogen-containing heterocyclic compound heterocyclic compound selected from the group consisting of the following formula (III) to (XVI) or a thiourea compound represented by the following formula (XVII):

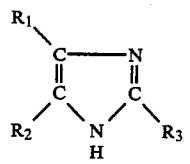
(III)

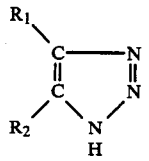
(IV)

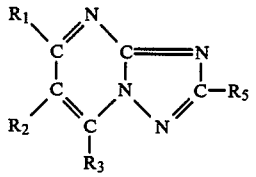
(V)

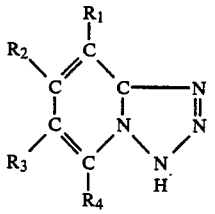
(VI)

-continued (VII)

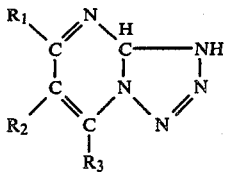

(VIII)

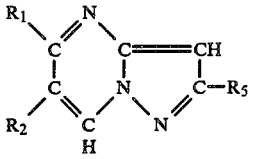

(IX)

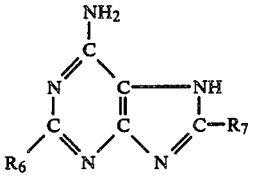

(X)

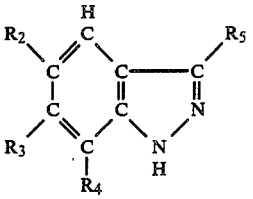

(XI)

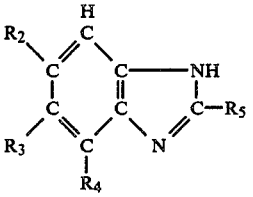

(XII)

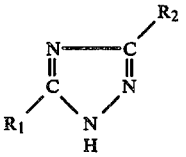

(XIII)

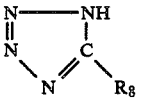

(XIV)

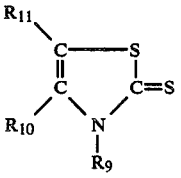

-continued (XV)

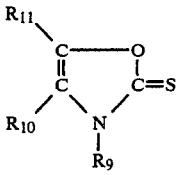

(XVI)

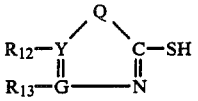

(XVII)

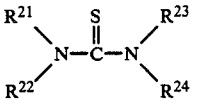

wherein $R_1$, $R_2$, $R_3$ and $R_4$ each represents a hydrogen atom, an alkyl group, an aralkyl group, an alkenyl group, an alkoxy group, an aryl group, —NRR′, —COOR, —$SO_3M$, —CONRR′, —NH-$SO_2R$, —$SO_2NRR'$, —$NO_2$, a halogen atom, —CN or a hydroxy group, wherein R and R′ each represents a hydrogen atom, an alkyl group, an aryl group or an aralkyl group, and M represents a hydrogen atom or an alkali metal atom, and when both $R_1$ and $R_2$ represent an alkyl group, they may combine with each other to form an aliphatic hydrocarbon ring;

$R_5$ represents a hydrogen atom, an alkyl group containing 1 to 5 carbon atoms, or —S—R″, wherein R″ represents a hydrogen atom, an alkyl group, an aryl group or an aralkyl group;

$R_6$ represents a hydrogen atom or an alkyl group;

$R_7$ represents a hydrogen atom, an alkyl group or an aryl group;

$R_8$ represents an alkyl group, an aryl group, a benzyl group, or a pyridyl group;

$R_9$ represents an alkyl group, an alkenyl group, or an aryl group;

$R_{10}$ and $R_{11}$ both represent an alkyl group, an alkenyl group, or an aryl group, and when both $R_{10}$ and $R_{11}$ are an alkenyl group, they may combine with each other to form an aromatic ring;

Q represents an oxygen atom, a sulfur atom or —NR‴, wherein R″ represents a hydrogen atom, an alkyl group, an unsaturated aliphatic hydrocarbon residue, or a substituted or unsubstituted aryl or aralkyl group;

Y and G each represents a carbon atom or a nitrogen atom;

$R_{12}$ and $R_{13}$ each represents a hydrogen atom, an alkyl group, an unsaturated aliphatic hydrocarbon residue, a substituted or unsubstituted aryl group, substituted or unsubstituted aralkyl group, —SR⁗ or —$NH_2$, wherein R⁗ represents a hydrogen atom, an alkyl group, an aryl group, an aralkyl group, an alkylcarboxylic acid or its alkali metal salt, or an alkylsulfinic acid or its alkali metal salt, and when Y and G both represent a carbon atom they may combine with each other to form an aromatic ring; and $R^{21}$ and $R^{24}$ may be the same or different, and each represents a hydrogen atom, a substituted or unsubstituted alkyl group, a substituted or unsubstituted alkenyl group, a substituted or unsubstituted aralkyl group, a substituted or unsubstituted aryl group, a nitrogen-containing heterocyclyl group or an acyl group.

* * * * *